US008850837B2

(12) United States Patent
Park et al.

(10) Patent No.: US 8,850,837 B2
(45) Date of Patent: Oct. 7, 2014

(54) HEAT PUMP TYPE SPEED HEATING APPARATUS

(75) Inventors: Noma Park, Changwon-Si (KR); Heewoong Park, Changwon-Si (KR); Hwanjong Choi, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 768 days.

(21) Appl. No.: 13/091,513

(22) Filed: Apr. 21, 2011

(65) Prior Publication Data

US 2011/0259024 A1 Oct. 27, 2011

(30) Foreign Application Priority Data

Apr. 23, 2010 (KR) ..... 10-2010-0038005

(51) Int. Cl.

| | |
|---|---|
| ***F25B 13/00*** | (2006.01) |
| ***F25B 7/00*** | (2006.01) |
| ***F25B 30/02*** | (2006.01) |
| ***F24D 19/10*** | (2006.01) |
| *F25B 40/04* | (2006.01) |

(52) U.S. Cl.

CPC . *F25B 7/00* (2013.01); *F25B 13/00* (2013.01); *F25B 30/02* (2013.01); *F24D 19/1072* (2013.01); *F25B 40/04* (2013.01)

USPC ..... 62/160

(58) Field of Classification Search

CPC ..... F25B 7/00; F25B 13/00; F25B 30/00; F25B 30/02; F25B 43/00; F25B 43/006; F25B 2400/04; F25B 2600/2501

USPC ..... 62/160, 175, 196.1, 324.1, 503, 509

See application file for complete search history.

(56) References Cited

U.S. PATENT DOCUMENTS

| | | | | |
|---|---|---|---|---|
| 4,562,700 | A * | 1/1986 | Atsumi et al. | 62/174 |
| 2006/0218948 | A1* | 10/2006 | Otake et al. | 62/160 |
| 2011/0016897 | A1* | 1/2011 | Akagi et al. | 62/161 |

FOREIGN PATENT DOCUMENTS

| | | |
|---|---|---|
| CN | 101535646 A | 9/2009 |
| JP | 55-37417 | 3/1980 |
| JP | 58-015170 | 1/1983 |
| JP | 59-13871 | 1/1984 |
| JP | 04-064063 | 2/1992 |
| JP | 2005-257231 | 9/2005 |
| JP | 2005-299935 | 10/2005 |
| KR | 10-0497161 | 6/2005 |

OTHER PUBLICATIONS

Chinese Office Action dated Jan. 14, 2013.
Korean Office Action dated Jan. 16, 2012.

* cited by examiner

*Primary Examiner* — Marc Norman
(74) *Attorney, Agent, or Firm* — KED & Associates, LLP

(57) ABSTRACT

A heat pump type speed heating apparatus, comprising: a cooling cycle circuit to circulate a first refrigerant to operate air conditioning, the cooling cycle circuit including a compressor, an outdoor heat exchanger, an expansion apparatus, and an indoor heat exchanger, a hot water supply compressor to compress a second refrigerant, a hot water supply heat exchanger to condense the compressed second refrigerant and to heat water, a hot water supply expansion apparatus to expand the second refrigerant from the hot water supply heat exchanger, and a cascade heat exchanger, connected to the cooling cycle circuit, to evaporate the second refrigerant expanded at the hot water supply expansion apparatus, and the first refrigerant to undergo condensation, expansion, and evaporation in the cooling cycle circuit.

19 Claims, 11 Drawing Sheets

HEAT PUMP TYPE SPEED HEATING APPARATUS

CROSS-REFERENCE TO RELATED APPLICATION

This application claims priority from Korean Application No. 10-2010-0038005, filed Apr. 23, 2010, the subject matter of which is incorporated herein by reference.

BACKGROUND

1. Field

Embodiments of the present invention may relate to a heat pump speed heating apparatus. More specifically, embodiments of the present invention may relate to a heat pump speed heating apparatus where heat of a refrigerant compressed in a compressor may be used for a hot water supply and an air conditioning.

2. Background

A heat pump is a cooling and heating apparatus that transfers a heat source at a low temperature to a high temperature or transfers a heat source at a high temperature to a low temperature by using heating or condensing of a refrigerant.

A heat pump may include a compressor, an outdoor heat exchanger, an expansion apparatus, and an indoor heat exchanger. Heat pump type speed heating apparatuses may be developed in which a hot water supply makes use of heating water by employing a refrigerant compressed in a compressor to minimize consumption of fossil fuel.

JP 2001-263857A, the subject matter of which is incorporated herein by reference, describes a cooling/heating and hot water supply apparatus and a method for controlling the same, where a refrigerant discharged from a compressor sequentially passes through a heat exchanger for a hot water supply, an outdoor heat exchanger, an expansion apparatus, and a heat exchanger for air conditioning and is recovered by the compressor, or the refrigerant discharged from the compressor is recovered by the compressor after sequentially passing through the heat exchanger for air conditioning, the expansion apparatus, and the outdoor heat exchanger.

A cooling/heating and hot water supply apparatus may use heat generated from a single cooling cycle for a heat exchanger for a hot water supply. However, the quick increasing of the water temperature to a high temperature may be restricted.

BRIEF DESCRIPTION OF THE DRAWINGS

Arrangements and embodiments may be described in detail with reference to the following drawings in which like reference numerals refer to like elements and wherein.

DETAILED DESCRIPTION

Embodiments may be described with reference to appended drawings. For the description of the embodiments, same names and symbols may be used for the same structure and an additional description according thereto may not be provided below.

Figure 1:
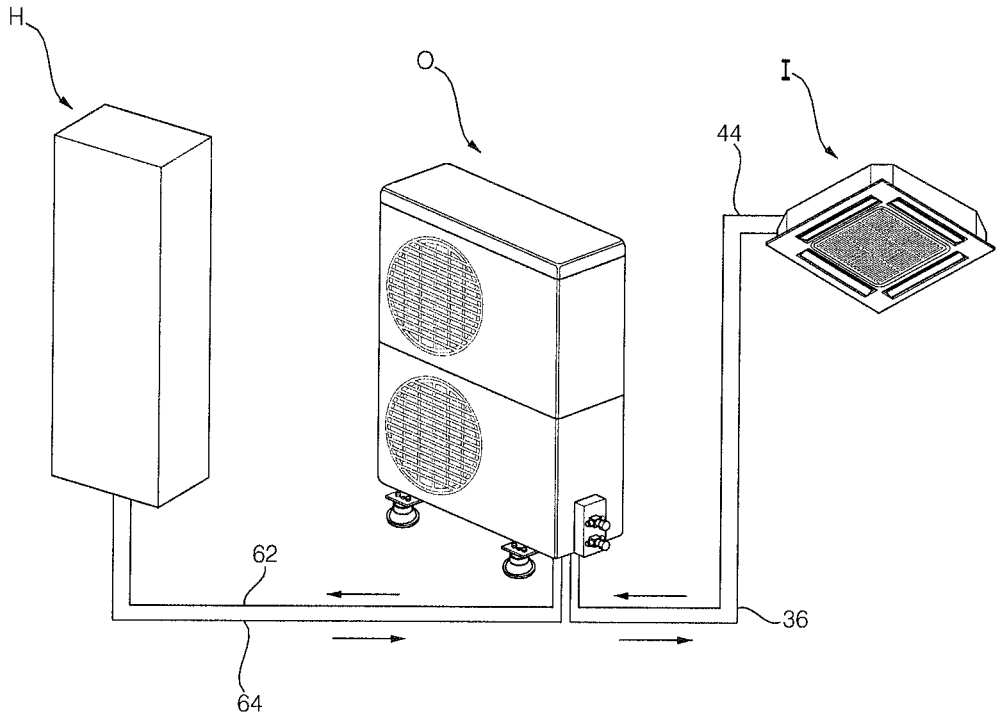
FIG. 1 is a view of a first embodiment of a heat pump type speed heating apparatus according to the present invention.
Figure 2:
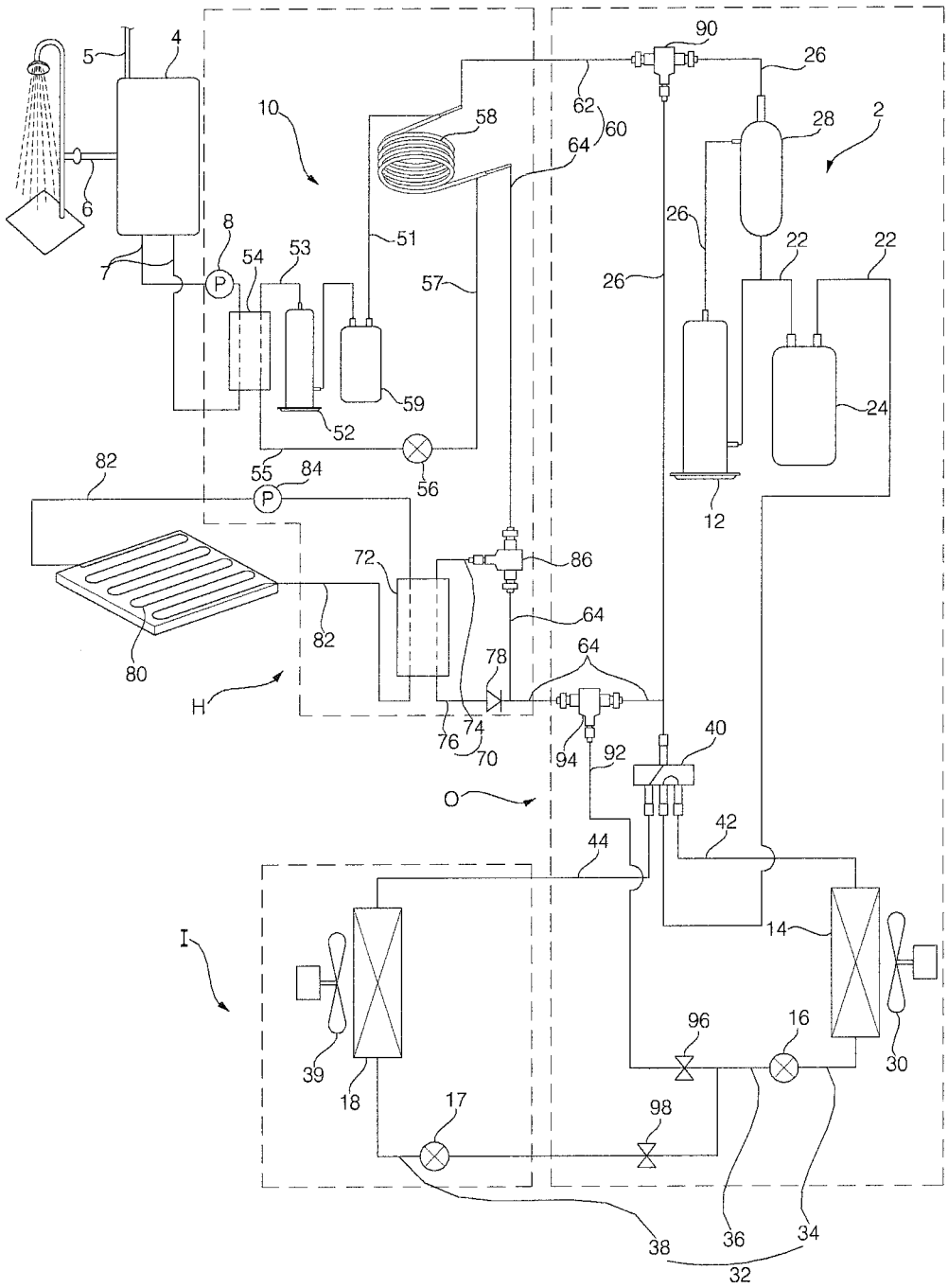
FIG. 2 is a block diagram of a first embodiment of a heat pump type speed heating apparatus according to the present invention.

FIG. 1 is a view of a first embodiment of a heat pump type speed heating apparatus according to the present invention. FIG. 2 is a block diagram of a first embodiment of a heat pump type speed heating apparatus according to the present invention. Other embodiments and configurations may also be provided.

As shown in FIG. 1, a heat pump type speed heating apparatus may include an outdoor unit O, an indoor unit I and a hot water supply unit H. The outdoor unit O may provide and receive first refrigerant from the indoor unit I. The outdoor unit O may also provide and receive second refrigerant from the hot water supply unit H.

As shown in FIG. 2, a heat pump type speed heating apparatus may include a cooling cycle circuit 2 (or cooling cycle part) where indoor air conditioning is performed by a first refrigerant and a hot water supply circuit 10 where water of a hot water supply tank 4 is heated by a second refrigerant.

The cooling cycle circuit 2 may perform a low temperature cooling cycle and the hot water supply circuit 10 may perform a high temperature cooling cycle that exchanges heat with the low temperature cooling cycle.

The first and the second refrigerant are composed of refrigerants, each of which has a condensation temperature and an evaporation temperature different from each other. For example, if the first refrigerant is R410a, which has a low condensation temperature and evaporation temperature, the second refrigerant can be composed of R134a, which has a higher condensation temperature and evaporation temperature than the first refrigerant.

The cooling cycle circuit 2 may include a compressor 12, an outdoor heat exchanger 14, an expansion apparatus 16, 17, and an indoor heat exchanger 18. Indoor air conditioning may be performed as the first refrigerant circulates the compressor 12, the outdoor heat exchanger 14, the expansion apparatus 16, 17, and the indoor heat exchanger 18.

The air conditioning operation of the cooling cycle circuit 2 may include a space heating operation where heating and air conditioning are carried out by an inflow of indoor air, and a space cooling operation where cooling and air conditioning may be carried out by an inflow of indoor air.

The cooling cycle circuit 2 may include an accumulator 24 in an inflow flow path 22 of the compressor 12, which prevents a liquid refrigerant from flowing into the compressor 12. The cooling cycle circuit 2 may also include an oil separator 28 provided in a discharge flow path 26 of the compressor 12, which separates oil from a mixture of the first refrigerant and oil discharged from the compressor 12 and recovers the oil to the compressor 12.

The outdoor heat exchanger 14 may condense or evaporate the first refrigerant. The outdoor heat exchanger 14 may be provided in the form of an air refrigerant heat exchanger where outdoor air exchanges heat with the first refrigerant or in the form of a water refrigerant heat exchanger where cooling water exchanges heat with the first refrigerant.

The outdoor heat exchanger 14, when provided in the form of an air refrigerant heat exchanger, may be equipped with an outdoor fan 30 that ventilates outdoor air to the outdoor heat exchanger 14.

The outdoor heat exchanger 14 may be connected to the indoor heat exchanger 18 by a heat exchanger connecting pipe 32.

The expansion apparatus 16, 17 may be provided at the heat exchanger connecting pipe 32.

The expansion apparatus 16, 17 may include an outdoor expansion apparatus 16 provided close to the outdoor heat exchanger 14. The expansion apparatus 16, 17 may also include an indoor expansion apparatus 17 provided close to the indoor heat exchanger 18.

The heat exchanger connecting pipe 32 may include an outdoor heat exchanger-outdoor expansion apparatus connecting pipe 34 that connects the outdoor heat exchanger 14 and the outdoor expansion apparatus 16, an expansion apparatus connecting pipe 36 that connects the outdoor expansion apparatus 16 and the indoor expansion apparatus 17, and an indoor expansion apparatus-indoor heat exchanger connecting pipe 38 that connects the indoor expansion apparatus 17 and the indoor heat exchanger 18.

The indoor heat exchanger 18 may perform cooling or heating an indoor space as the indoor air exchanges heat with the first refrigerant. An indoor fan 39 may circulate the indoor air to the indoor heat exchanger 18.

The cooling cycle circuit 2 may be provided in the form of a cooling air conditioner that cools down the indoor air since the cooling cycle circuit 2 is connected such that the first refrigerant compressed in the compressor 12 sequentially passes through the outdoor heat exchanger 14, the expansion apparatus 16, 17, and the indoor heat exchanger 18, and is recovered by the compressor 12.

The cooling cycle circuit 2 may also be provided in the form of a heating air conditioner that heats up the indoor air since the cooling cycle circuit 2 is connected such that the first refrigerant compressed in the compressor 12 sequentially passes through the indoor heat exchanger 18, the expansion apparatus 16, 17, and the outdoor heat exchanger 14, and is recovered by the compressor 12.

The cooling cycle circuit 2 may be provided in the form of an air conditioner for both cooling and heating, where the first refrigerant compressed in the compressor 12, at a time of heating operation, sequentially passes through the outdoor heat exchanger 14, the expansion apparatus 16, 17, and the indoor heat exchanger 18, and is recovered by the compressor 12, and the first refrigerant compressed in the compressor 12, at a time of a cooling operation, sequentially passes through the indoor heat exchanger 18, the expansion apparatus 16, 17, and the outdoor heat exchanger 18, and is recovered by the compressor 12.

The cooling cycle circuit 2 may be provided for the indoor heat exchanger 18 to cool down or heat up an indoor space. The cooling cycle circuit 2 may include an air conditioner for both cooling and heating, which may switch between a cooling operation and a heating operation.

The cooling cycle circuit 2 may further include a cooling/heating switching valve 40 that circulates the first refrigerant in an order of the compressor 12, the outdoor heat exchanger 14, the expansion apparatus 16, 17, and the indoor heat exchanger 18, or in an order of the compressor 12, the indoor heat exchanger 18, the expansion apparatus 16, 17, and the outdoor heat exchanger 14.

The cooling/heating switching valve 40 may be connected to the compressor 12 through a compressor inflow flow path 22 and a compressor discharge flow path 26. The cooling/heating switching valve 40 may be connected to the outdoor heat exchanger 14 through an outdoor heat exchanger connecting pipe 42, and the cooling/heating switching valve 40 may be connected to the indoor heat exchanger 18 through an indoor heat exchanger connecting pipe 44.

The hot water supply tank 4 may be connected to a water supply unit 5 through which external water is supplied to the hot water supply tank 4 and to a water outflow unit 6 through which water of the hot water supply tank 4 flows out.

The hot water supply tank 4 may be connected to a hot water supply heat exchanger 54 and a hot water pipe 7 of a hot water supply circuit 10, as will be described below. The hot water pump 8 may be provided at the hot water pipe 7.

Water flowing into the hot water supply tank 4 after being heated in the hot water supply heat exchanger 54 may flow out to the water outflow unit 6.

A hot water supply coil connected to the hot water pipe 7 may be provided inside the hot water supply tank 4. Water heated in the hot water supply heat exchanger 54 may heat the inside of the hot water supply tank 4 while passing through the hot water supply coil. Water flowing into the water supply unit 5 may be heated by the hot water supply coil and flow out to the water outflow unit 6.

The hot water supply circuit 10 may include: a hot water supply compressor 52 where a second refrigerant is compressed, the hot water supply heat exchanger 54 where the second refrigerant compressed in the hot water supply compressor 52 is condensed while heating the water, a hot water supply expansion apparatus 56 where the second refrigerant compressed in the hot water supply heat exchanger 54 is expanded, and a cascade heat exchanger 58 where the first refrigerant discharged from the compressor 12 evaporates the second refrigerant expanded in the hot water supply expansion apparatus 56.

The hot water supply compressor 52 may be connected to the cascade heat exchanger 58 through a compressor inflow flow path 51 and may be connected to the hot water supply heat exchanger 54 through a compressor discharge flow path 53.

The hot water supply heat exchanger 54 may be connected to the hot water supply expansion apparatus 56 through a hot water supply heat exchanger-hot water supply expansion apparatus connecting pipe 55.

The hot water supply expansion apparatus 56 may be connected to the cascade heat exchanger 58 through a hot water supply expansion apparatus-cascade heat exchanger connecting pipe 57.

The cascade heat exchanger 58 may be a desuperheater that is formed as the first refrigerant overheated at the compressor 12 is condensed while exchanging heat with the second refrigerant used for a hot water supply.

The cascade heat exchanger 58 may have a first refrigerant flow path through which the first refrigerant overheated passes and a second refrigerant flow path through which the second refrigerant used for hot water supply passes.

The cascade heat exchanger 58 may be formed as a double pipe heat exchanger such that the first refrigerant flow path and the second refrigerant flow path are provided to have a heat transfer member between them; or as a sheet type heat exchanger formed such that the first refrigerant flow path and the second refrigerant flow path are provided in an alternate fashion to have the heat transfer member between them.

In the cascade heat exchanger 58, the second refrigerant flow path may be connected to the hot water supply compressor 52 through a compressor inflow flow path 51.

In the compressor inflow flow path 51, an accumulator 59 can be provided in which a liquid refrigerant is accumulated to prevent the liquid refrigerant from flowing into the hot water supply compressor 52.

The cascade heat exchanger 58 may be connected such that the first refrigerant discharged from the compressor 12 can be condensed, expanded, and evaporated in the cooling cycle circuit 2 after passing through the cascade heat exchanger 58.

In other words, since the heat pump type speed heating apparatus allows the first refrigerant to be condensed in the cascade heat exchanger 58 and then to be condensed, expanded, and evaporated in the cooling cycle circuit 2, efficiency may be improved while simultaneously performing hot water supply operation and air conditioning operation. Additionally, the second refrigerant evaporated in the cascade heat exchanger 58 by the first refrigerant may heat the water of the hot water supply heat exchanger 54 as the second refrigerant is condensed in the hot water supply heat exchanger 54. The hot water supply temperature may increase to a much higher temperature when the first refrigerant heats water of the hot water supply heat exchanger 54 while passing directly through the hot water supply heat exchanger 54.

The cascade heat exchanger 58 can be connected to the cooling cycle circuit 2 through a hot water supply flow path 60 for the first refrigerant to selectively pass through the cascade heat exchanger 58.

The hot water supply path 60 is a flow path through which the first refrigerant passes to be used for a hot water supply. The hot water supply path 60 may include a hot water supply inflow flow path 62 that leads the first refrigerant of the cooling cycle circuit 2, and more particularly the first refrigerant compressed in the compressor 12, to flow through a first refrigerant flow path of the cascade heat exchanger 58 and a hot water supply outflow flow path 64 that leads the first refrigerant flowed out from a first refrigerant flow path of the cascade heat exchanger 58 to flow through the cooling cycle circuit 2, and more particularly a cooling/heating switching valve 40.

The hot water supply inflow flow path 62 and the hot water supply outflow path 64 may be connected to the compressor 12 and the cooling/heating switching valve 40, respectively.

One end of the hot water supply inflow flow path 62 may be connected to a compressor discharge flow path 26 while the other end of the hot water supply inflow flow path 62 may be connected to the cascade heat exchanger 58.

One end of the hot water supply outflow flow path 64 can be connected to the cascade heat exchanger 58 while the other end of the hot water supply outflow flow path 64 can be connected to the compressor discharge flow path 26.

The heat pump type speed heating apparatus may allow the first refrigerant, which heats the cascade heat exchanger 58 to flow directly into the cooling cycle circuit 2 and at the same time to flow into the cooling cycle circuit 2 after being used for floor heating or air conditioning of an indoor space.

The heat pump type speed heating apparatus having the first refrigerant that has heated the cascade heat exchanger 58 may use the first refrigerant again for air conditioning by the cooling cycle circuit 2 after being used for floor heating or air conditioning of an indoor space.

The heat pump type speed heating apparatus may further include a water refrigerant heat exchanger 72 connected to a water refrigerant heat exchanger connecting flow path 70 for the first refrigerant that has passed the cascade heat exchanger 58 to be condensed, expanded, and evaporated in the cooling cycle circuit 2 after heating the water.

The water refrigerant heat exchanger 72 may be connected to the hot water supply flow path 60 through the water refrigerant heat exchanger connecting flow path 70.

The water refrigerant heat exchanger connecting flow path 70 may include a floor heating inflow flow path 74 where the first refrigerant of the hot water supply outflow flow path 64 flows into the water refrigerant heat exchanger 72 and a floor heating outflow flow path 76 where the first refrigerant that has passed the water refrigerant heat exchanger 72 flows out through the hot water outflow flow path 64.

In the floor heating outflow flow path 76, a check valve 78 may be provided to prevent the first refrigerant of the hot water supply outflow flow path 64 from passing through the floor heating outflow flow path 76 and flowing backward to the water refrigerant heat exchanger 72.

The water refrigerant heat exchanger 72 may be a condensation heat exchanger where the refrigerant condensed for the first time in the cascade heat exchanger 58 is additionally condensed while exchanging heat with water.

The water refrigerant heat exchanger 72 may have a refrigerant flow path through which the first refrigerant (that has passed the cascade heat exchanger 58) passes and a water flow path through which water used for floor heating or indoor air conditioning passes.

The water refrigerant heat exchanger 72 may be a double pipe heat exchanger formed such that the refrigerant flow path and the water flow path are disposed to have a heat transfer member between them; or as a sheet type heat exchanger formed such that the refrigerant and the water flow path are disposed in an alternate fashion to have the heat transfer member between them.

The water refrigerant heat exchanger 72 may be connected to a floor heating pipe 80 installed in an indoor floor through a heating water pipe 82. If a floor heating pump 84 is installed at the heating water pipe 82, heat of the first refrigerant that has passed the cascade heat exchanger 58 may be additionally used for indoor floor heating.

The heat pump type speed heating apparatus may include a water refrigerant heat exchanger refrigerant controller 86 that controls flow of the first refrigerant that has passed the cascade heat exchanger 58 to pass the water refrigerant heat exchanger 72 or to bypass the water refrigerant heat exchanger 72.

The water refrigerant heat exchanger 72 may be directly connected to the hot water supply outflow flow path 64 for the refrigerant that has passed the cascade heat exchanger 58 to be used for floor heating. However, the water refrigerant heat exchanger 72 may be installed such that the user may selectively operate the floor heating.

The water refrigerant heat exchanger refrigerant controller 86 may be composed of a floor heating valve that allows the first refrigerant to pass through the water refrigerant heat exchanger 72 when the user selects floor heating.

If the operation of the heat pump type speed heating apparatus includes a floor heating operation then the water refrigerant heat exchanger refrigerant controller 86 can control a flow direction of the refrigerant for the first refrigerant to flow into the water refrigerant heat exchanger 72. On the other hand, if the operation of the heat pump type speed heating apparatus does not include a floor heating operation, then the water refrigerant heat exchanger refrigerant controller 86 can control the flow of the refrigerant for the first refrigerant to bypass the water refrigerant heat exchanger 72.

The water refrigerant heat exchanger refrigerant controller 86 may control the first refrigerant to flow into the water refrigerant heat exchanger 72 at the time of floor heating operation, at the time of simultaneous operation of floor heating and hot water supply, and at the time of simultaneous operation of floor heating, hot water supply, and air conditioning.

The air conditioning operation may include a space cooling operation that cools down an indoor space and a space heating operation that heats up the indoor space.

The water refrigerant heat exchanger refrigerant controller 86 may include a three-way valve provided at the hot water supply flow path 60, and more particularly at the hot water supply outflow flow path 64 to select an outflow direction of the first refrigerant.

If the water refrigerant heat exchanger refrigerant controller 86 is a three-way valve, an inlet port and a first outlet port thereof may be connected to the hot water supply outflow flow path 64 and a second outlet port thereof may be connected to the floor heating inflow flow path 74.

The heat pump type speed heating apparatus may further include a refrigerant controller 90 that controls the flow direction of the first refrigerant discharged from the compressor 12 to pass through the cascade heat exchanger 58 or to bypass the cascade heat exchanger 58.

If the operation of the heat pump type speed heating apparatus includes at least one of a hot water supply operation and a floor heating operation, the refrigerant controller 90 controls the first refrigerant compressed at the compressor 12 to flow into the cascade heat exchanger 58. On the other hand, if the operation of the heat pump type speed heating apparatus includes neither the hot water supply operation nor the floor heating operation, the refrigerant controller 90 may control the first refrigerant compressed at the compressor 12 to bypass the cascade heat exchanger 58.

The refrigerant controller 90, at the time of the hot water supply operation, may control the first refrigerant to flow into the cascade heat exchanger 58.

The refrigerant controller 90, at the time of simultaneous operation of the hot water supply and the air conditioning, may control the first refrigerant to flow into the cascade heat exchanger 58.

The refrigerant controller 90, at the time of simultaneous operation of the hot water supply and the floor heating, may control the first refrigerant to flow into the cascade heat exchanger 58.

The refrigerant controller 90, at the time of simultaneous operation of the hot water supply, the floor heating, and the air conditioning, may control the first refrigerant to flow into the cascade heat exchanger 58.

The refrigerant controller 90, at the time of floor heating operation, may control the first refrigerant to flow into the cascade heat exchanger 58.

The refrigerant controller 90, at the time of air conditioning operation, may control the first refrigerant to bypass the cascade heat exchanger 58. In other words, the refrigerant controller 90 may control the first refrigerant to bypass the cascade heat exchanger 58 at the time of the space cooling operation and may control the first refrigerant to bypass the cascade heat exchanger 58 at the time of the space heating operation.

The refrigerant controller 90 may include a three-way valve that is installed in the cooling cycle circuit 2, and the refrigerant controller 90 may select the outflow direction of the refrigerant.

If the refrigerant controller 90 is a three-way valve, then an inlet port and a first outlet port thereof may be connected to the compressor outflow flow path 26 and a second outlet port may be connected to the hot water supply inflow flow path 62.

The heat pump type speed heating apparatus may include a heat exchanger bypass flow path 92 connected to guide the first refrigerant, which has passed the cascade heat exchanger 58 between the outdoor heat exchanger 14 and the indoor heat exchanger 18 to make the first refrigerant, which has passed the cascade heat exchanger 58, to bypass one of the outdoor heat exchanger 14 and the indoor heat exchanger 18.

One end of the heat exchanger bypass flow path 92 may be connected to the hot water supply flow path 60 and the other end of the heat exchanger bypass flow path 92 may be connected between the indoor expansion apparatus 17 and the outdoor expansion apparatus 16.

The heat exchanger bypass flow path 92 may guide the refrigerant of the hot water outflow flow path 64 between the indoor expansion apparatus 17 and the outdoor expansion apparatus 16 as one end of the heat exchanger bypass flow path 92 is connected to the hot water outflow flow path 64 of the hot water flow path 60 and the other end of the heat exchanger bypass flow path 92 is connected to an expansion apparatus connecting pipe 36.

The refrigerant guided to the heat exchanger bypass flow path 92 may be expanded in the indoor expansion apparatus 17 and may be recovered by the compressor 12 after being evaporated; or the refrigerant may be expanded in the outdoor expansion apparatus 16 and may be recovered by the compressor 12 after being evaporated at the outdoor heat exchanger 14.

If the refrigerant is guided between the indoor expansion apparatus 17 and the outdoor expansion apparatus 16 through the heat exchanger bypass flow path 92, a condensation process is not generated but only an expansion and an evaporation process are generated in the cooling cycle circuit 2; the amount of heat transferred of the cascade heat exchanger 58 and the water refrigerant heat exchanger 72 is increased; and efficiency of hot water supply and floor heating is enhanced.

The heat pump type speed heating apparatus may further include an auxiliary refrigerant controller 94 that controls the flow direction of the first refrigerant that has passed the cascade heat exchanger 58 such that the first refrigerant that has passed the cascade heat exchanger 58 can either pass through heat exchanger bypass flow path 92 or bypass the heat exchanger bypass flow path 92.

If the operation of the heat pump type speed heating apparatus includes both hot water supply and air conditioning, the auxiliary refrigerant controller 94 may control the refrigerant that has passed the cascade heat exchanger 58 to bypass the heat exchanger bypass flow path 92.

The auxiliary refrigerant controller 94 may control the refrigerant that has passed the cascade heat exchanger 58 to bypass the heat exchanger bypass flow path 92 at the time of simultaneous operation of the hot water supply and the air conditioning.

The auxiliary refrigerant controller 94 may control the refrigerant that has passed the cascade heat exchanger 58 to bypass the heat exchanger bypass flow path 92 at the time of simultaneous operation of the hot water supply, the floor heating, and the air conditioning.

The auxiliary refrigerant controller 94 may control the refrigerant that has passed the cascade heat exchanger 58 to bypass the heat exchanger bypass flow path 92 at the time of operation of the air conditioning.

The auxiliary refrigerant controller 94 may control the refrigerant that has passed the cascade heat exchanger 58 to bypass the heat exchanger bypass flow path 92 at the time of operation of the hot water supply.

The auxiliary refrigerant controller 94 may control the refrigerant that has passed the cascade heat exchanger 58 to bypass the heat exchanger bypass flow path 92 at the time of simultaneous operation of the hot water supply and the floor heating.

The auxiliary refrigerant controller 94 can control the refrigerant that has passed the cascade heat exchanger 58 to bypass the heat exchanger bypass flow path 92 at the time of operation of the floor heating.

If defrosting conditions occur during the hot water supply operation, the auxiliary refrigerant controller 94 may control the refrigerant that has passed the cascade heat exchanger 58 to bypass the heat exchanger bypass flow path 92, and at this time the cooling cycle circuit 2 may be switched from the heating operation to the cooling operation for defrost of the outdoor heat exchanger 14 and the outdoor heat exchanger 14. Defrosting of the outdoor heat exchanger 14 may be described below in detail.

The auxiliary refrigerant controller 94 can include a three-way valve installed at the hot water supply outflow flow path 64 to select an outflow direction of the refrigerant.

If the auxiliary refrigerant controller 94 is a three-way valve, an inlet port and a first outlet port thereof can be connected to the hot water supply outflow flow path 64 and a second outlet port thereof can be connected to the heat exchanger bypass flow path 92.

The heat pump type speed heating apparatus may further include a heat exchanger bypass valve 96 installed in the heat exchanger bypass flow path 92 for controlling the flow of the refrigerant, and a liquid refrigerant valve 98 installed between the heat exchanger bypass flow path 92 and the indoor expansion apparatus 17 for controlling the flow of the refrigerant.

The heat exchanger bypass valve 96 may be opened in an example of simultaneous operation of the hot water supply and the floor heating, the floor heating operation, and/or the hot water supply operation. The heat exchanger bypass valve 96 can be closed in the case of the air conditioning operation, simultaneous operation of the air conditioning and the hot water supply, and/or simultaneous operation of the air conditioning, the hot water supply, and the floor heating.

The liquid refrigerant valve 98 may be opened in an example of the air conditioning operation, simultaneous operation of the air conditioning and the hot water supply, and/or simultaneous operation of the air conditioning, the hot water supply, and the floor heating. The liquid refrigerant valve 98 may be closed in the example of simultaneous operation of the hot water supply and the floor heating, the floor heating operation, and/or the hot water supply operation.

The heat pump type speed heating apparatus may be composed of a separation type air conditioner where the cooling cycle circuit 2 includes the outdoor unit O and the indoor unit I; and the hot water supply unit H can be connected to the outdoor unit O.

The compressor 12, the cooling/heating switching valve 40, the outdoor heat exchanger 14, the outdoor expansion apparatus 16, and the outdoor fan 30 may be provided in the outdoor unit O.

The indoor expansion apparatus 17 and the indoor heat exchanger 18 may be provided in the indoor unit I.

The hot water supply compressor 52, the hot water heat exchanger 54, the hot water expansion apparatus 56, the cascade heat exchanger 58, and the hot water pump 8 may be provided in the hot water supply unit H.

The water refrigerant heat exchanger 72, the floor heating pump 84, and the water refrigerant heat exchanger refrigerant controller 86 may be provided in the hot water supply unit H.

The refrigerant controller 90, the heat exchanger bypass flow path 92, the auxiliary refrigerant controller 94, the heat exchanger bypass valve 96, and the liquid refrigerant valve 98 may be provided in the outdoor unit O.

Figure 3:
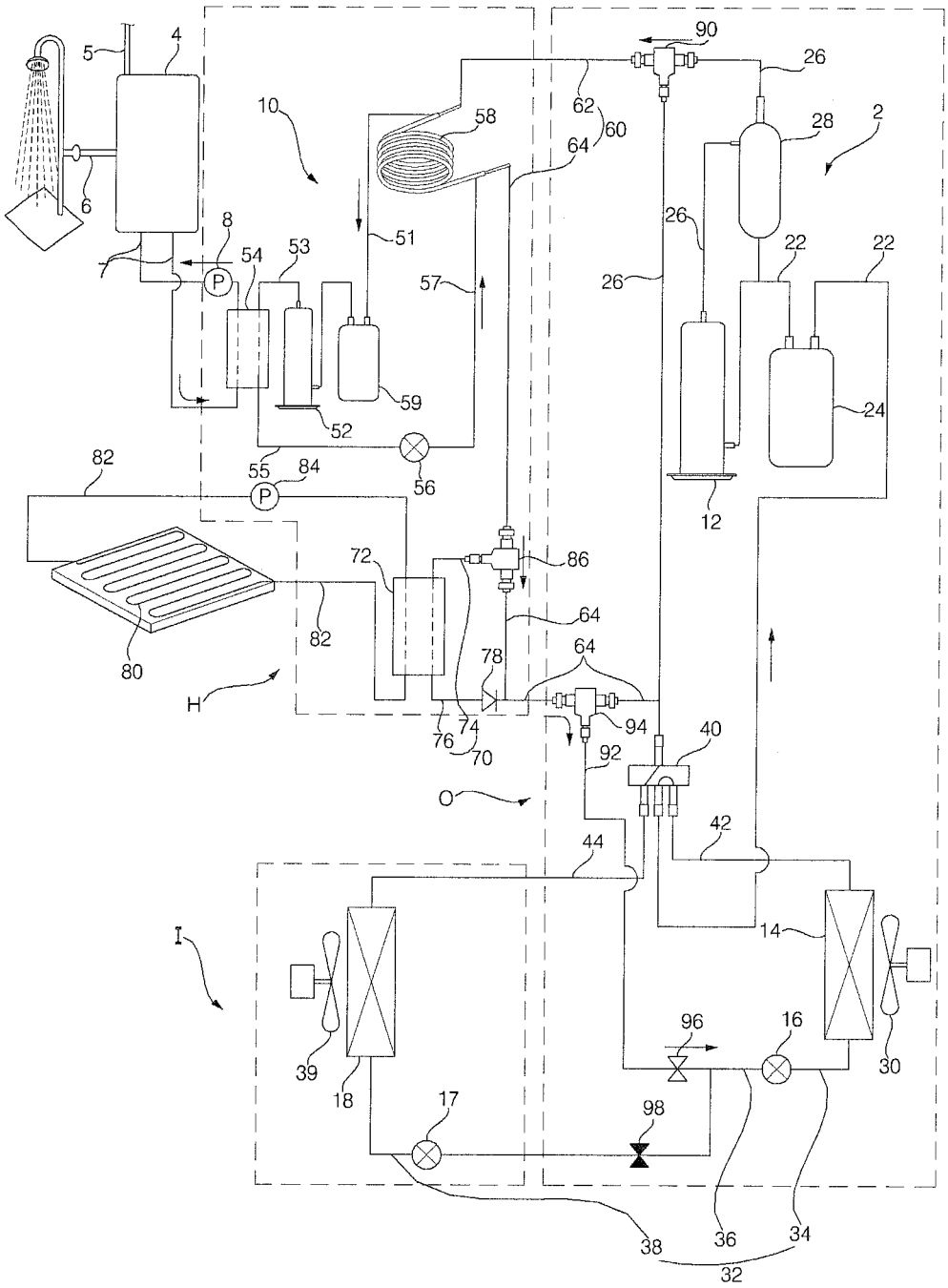
FIG. 3 is a block diagram illustrating a flow of a refrigerant when the first embodiment of the heat pump type speed heating apparatus (FIG. 2) is in a hot water supply operation.

FIG. 3 is a block diagram illustrating a flow of a refrigerant when the first embodiment of the heat pump type speed heating apparatus (FIG. 2) is in a hot water supply operation. Other embodiments and configurations may be provided.

The heat pump type speed heating apparatus, in an example of a hot water supply operation, may operate as follows.

The compressor 12 may be operated. The refrigerant controller 90 may be controlled for the first refrigerant to flow into the cascade heat exchanger 58. The water refrigerant heat exchanger refrigerant controller 86 may be controlled for the refrigerant of the hot water supply outflow flow path 64 to bypass the water refrigerant heat exchanger 72. The auxiliary refrigerant controller 64 may be controlled for the refrigerant of the hot water supply outflow flow path 64 to pass through the heat exchanger bypass flow path 92. The outdoor fan 30 may rotate, and the indoor fan 39 may not rotate. The cooling/heating switching valve 40 may operate in a heating mode. The heat exchanger bypass valve 96 may be opened, and the liquid refrigerant valve 98 may be closed. The hot water pump 8 and the hot water supply compressor 52 may be operated, and the floor heating pump 84 may not be operated.

At the time of operation of the compressor 12, the first refrigerant compressed at the compressor 12 may pass through the refrigerant controller 90 and the hot water supply inflow flow path 62, and may flow into the cascade heat exchanger 58. The first refrigerant heated at the compressor 12 may be condensed by exchanging heat with the second refrigerant while passing through the cascade heat exchanger 58.

At the time of operating the hot water supply compressor 52, the second refrigerant compressed at the hot water supply compressor 52 may be condensed at the hot water supply heat exchanger 54 and may be expanded at the hot water supply expansion apparatus 56. The second refrigerant may then be evaporated by taking away the heat of the first refrigerant while passing through the cascade heat exchanger 58, and the second refrigerant may be recovered by the hot water supply compressor 52.

At the time of operating the hot water pump 8, the water of the hot water supply tank 4 may flow into the hot water supply heat exchanger 54 through the hot water pipe 7. The water of the hot water supply tank 4 may then pass through the hot water supply heat exchanger 54 and may be circulated to the hot water supply tank 4. Water at a much higher temperature (than when the hot water supply circuit 10 is not included) may flow into the inside of the hot water supply tank 4.

The first refrigerant condensed at the cascade heat exchanger 58 may flow into the water refrigerant heat exchanger refrigerant controller 86 and bypass the water refrigerant heat exchanger 72 and flow into the auxiliary refrigerant controller 94. The first refrigerant that has flowed into the auxiliary refrigerant controller 94 may flow into the heat exchanger bypass flow path 92, and may be expanded at the outdoor expansion apparatus 16 after passing through the heat exchanger bypass valve 96. The first refrigerant expanded in the outdoor expansion apparatus 16 may evaporate in the outdoor heat exchanger 14 by exchanging heat with outdoor air, and may be recovered by the compressor 12 after passing through the cooling/heating switching valve 40.

The first refrigerant discharged from the compressor 12 may be recovered by the compressor 12 after sequentially passing through the cascade heat exchanger 58, the heat exchanger bypass flow path 92, the outdoor expansion apparatus 16, the outdoor heat exchanger 14, and the cooling/heating switching valve 40.

The cascade heat exchanger 58 may evaporate the second refrigerant by condensing the first refrigerant. The outdoor heat exchanger 14 may evaporate the first refrigerant. The hot water supply heat exchanger 54 may condense the second refrigerant, and the hot water supply heat exchanger 54 may heat the water of the hot water supply tank 4.

The heat pump type speed heating apparatus may use the first refrigerant and the second refrigerant to heat the water of the hot water supply tank 4 at the time of hot water supply operation Therefore, the water temperature of the hot water supply tank 4 may increase more quickly than an example where the first refrigerant passes through the indoor heat exchanger 18.

Figure 4:
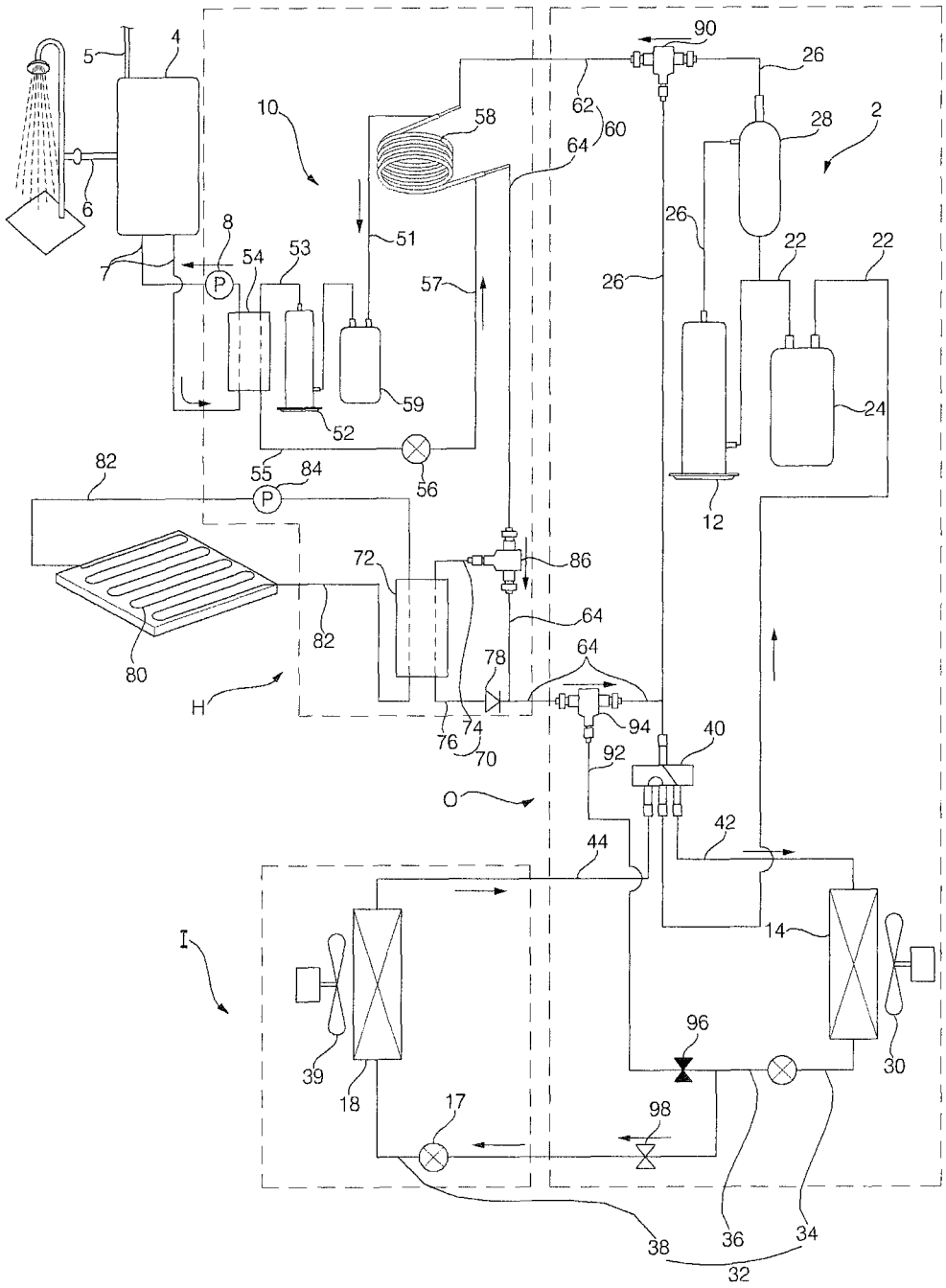
FIG. 4 is a block diagram illustrating a flow of a refrigerant when the first embodiment of the heat pump type speed heating apparatus (FIG. 3) is in a defrosting operation during a hot water supply operation.

FIG. 4 is a block diagram illustrating a flow of a refrigerant when the first embodiment of the heat pump type speed heating apparatus (FIG. 3) is in a defrosting operation during a hot water supply operation. Other embodiments and configurations may also be provided.

Since the outdoor heat exchanger 14 functions as an evaporator at the time of operation of the hot water supply, a frost can be developed at the outdoor heat exchanger 14. If defrosting conditions are provided for the outdoor heat exchanger 14, the outdoor heat exchanger 14 may be switched to defrost while the heat pump type speed heating apparatus continues the hot water supply operation.

The heat pump type speed heating apparatus may control the auxiliary refrigerant controller 94 for the first refrigerant that has passed the cascade heat exchanger 58 to bypass the heat exchanger bypass flow path 92 and may switch the cooling cycle circuit 2 from the heating operation to the cooling operation.

The defrosting conditions may be such that an accumulated time of the hot water supply operation is a predetermined time or more; and the temperature of the outdoor heat exchanger 14 may be a predetermined temperature or less for a predetermined time period or more.

The auxiliary refrigerant controller 94 may control the refrigerant to flow into the cooling/heating switching valve 40 during the hot water supply operation. The cooling/heating switching valve 40 may be operated in a cooling mode. The liquid refrigerant valve 98 may be opened, and the heat exchanger bypass valve 96 may be closed.

The first refrigerant condensed while passing through the cascade heat exchanger 58 after being compressed by the compressor 12 may bypass the heat exchanger bypass flow path 92 as the first refrigerant passes through the auxiliary refrigerant controller 94, and may flow into the cooling/heating switching valve 40. The first refrigerant that has passed the cooling/heating switching valve 40 may flow into the outdoor heat exchanger 14 and may be condensed again while defrosting the outdoor heat exchanger 14. Afterwards, the first refrigerant may expand as the first refrigerant passes through at least one of the outdoor expansion apparatus 16 and the indoor expansion apparatus 17 and may be evaporated as the first refrigerant passes through the indoor heat exchanger 18. The first refrigerant evaporated at the indoor heat exchanger 18 may pass through the cooling/heating switching valve 40 and may be recovered by the compressor 12.

The first refrigerant discharged from the compressor 12 may be recovered by the compressor 12 after sequentially passing through the cascade heat exchanger 58, the cooling/heating switching valve 40, the outdoor heat exchanger 14, the outdoor expansion apparatus 16, the indoor expansion apparatus 17, the indoor heat exchanger 18, and the cooling/heating switching valve 40.

The heat pump type speed heating apparatus may be defrosted as the cascade heat exchanger 58 condenses the first refrigerant and the outdoor heat exchanger 14 condenses the refrigerant. The hot water supply heat exchanger 54 may heat the water of the hot water supply tank 4.

Since the outdoor heat exchanger 14 is defrosted as the first refrigerant and the second refrigerant continuously heats the water of the hot water supply tank 4 at the time of the hot water supply operation of the heat pump type speed heating apparatus, the water temperature of the hot water supply tank 4 may increase more quickly and an efficiency of the hot water supply may be enhanced.

Figure 5:
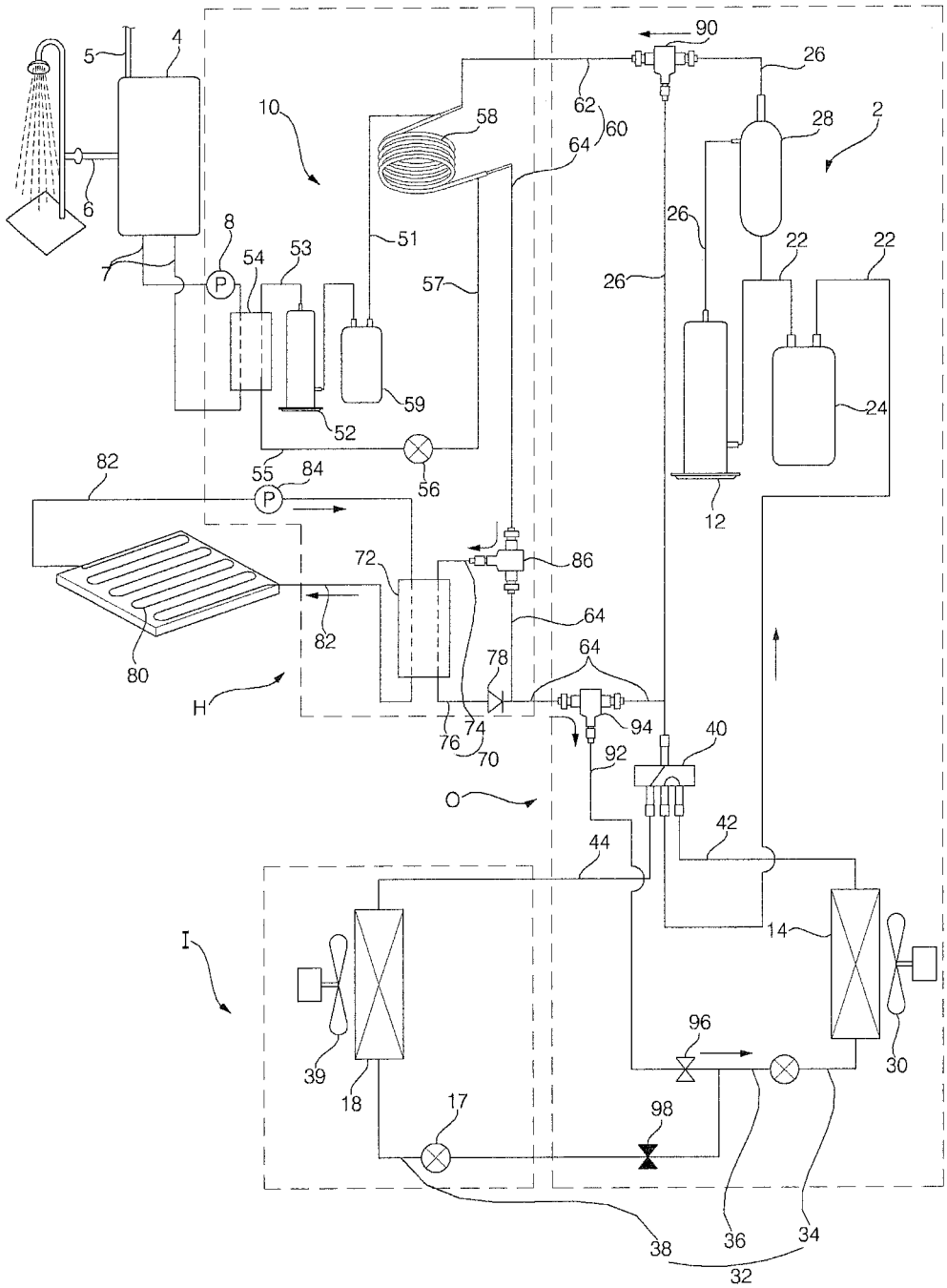
FIG. 5 is a block diagram illustrating a flow of a refrigerant when the first embodiment of the heat pump type speed heating apparatus (FIG. 2) is in a floor heating operation.

FIG. 5 is a block diagram illustrating a flow of a refrigerant when the first embodiment of the heat pump type speed heating apparatus (FIG. 2) is in a floor heating operation. Other embodiments and configurations may also be provided.

The heat pump type speed heating apparatus, in an example of a floor heating operation, may operate as follows.

The compressor 12 may be operated. The refrigerant controller 90 may be controlled for the first refrigerant to flow into the cascade heat exchanger 58. The water refrigerant heat exchanger refrigerant controller 86 may be controlled for the refrigerant of the hot water supply outflow flow path 64 to pass through the water refrigerant heat exchanger 72. The auxiliary refrigerant controller 64 may be controlled for the refrigerant of the hot water supply outflow flow path 64 to pass through the heat exchanger bypass flow path 92. The outdoor fan 30 may rotate, and the indoor fan 39 may not rotate. The cooling/heating switching valve 40 may be operated in a heating mode. The heat exchanger bypass valve 96 may be opened, and the liquid refrigerant valve 98 may be closed. The hot water pump 60 and the hot water supply compressor 52 may not be operated, and the floor heating pump 84 may be operated.

At the time of operating the floor heating pump 84, the water of the floor heating pipe 80 may flow into the water refrigerant heat exchanger 72 through the heating water pump 82, may pass through the water refrigerant heat exchanger 72, and may be circulated to the floor heating pipe 80.

At the time of operation of the compressor 12, the first refrigerant compressed at the compressor 12 may pass through the refrigerant controller 90 and the hot water supply inflow flow path 62 and may flow into the cascade heat exchanger 58, pass the cascade heat exchanger 58 without exchanging heat, and flow into the water refrigerant heat exchanger refrigerant controller 86. The first refrigerant that has flowed into the water refrigerant heat exchanger refrigerant controller 86 may flow into the water refrigerant heat exchanger 72 through the floor heating inflow flow path 74 and may be condensed by exchanging heat with water while passing through the water refrigerant heat exchanger 72. The first refrigerant condensed at the water refrigerant heat exchanger 72 may flow into the hot water outflow flow path 64 through the floor heating inflow flow path 76 and may then flow into the heat exchanger bypass flow path 92 by passing through the auxiliary refrigerant controller 94. The first refrigerant that has flowed into the heat exchanger bypass flow path 92 may be expanded at the outdoor expansion apparatus 16 after passing through the heat exchanger bypass valve 96 and may be evaporated at the outdoor heat exchanger 14 by exchanging heat with outdoor air. The first refrigerant evaporated at the outdoor heat exchanger 14 may be recovered by the compressor 12 by passing through the cooling/heating switching valve 40.

The first refrigerant discharged from the compressor 12 may be recovered by the compressor 12 after sequentially passing through the cascade heat exchanger 58, the water refrigerant heat exchanger 72, the heat exchanger bypass flow path 92, the outdoor expansion apparatus 16, the outdoor heat exchanger 14, and the cooling/heating switching valve 40.

The water refrigerant heat exchanger 72 may condense the first refrigerant. The outdoor heat exchanger 14 may evaporate the first refrigerant, and the water refrigerant heat exchanger 72 may heat the water of the floor heating pipe 80.

The heat pump type speed heating apparatus may use the first refrigerant to heat the water of the floor heating pipe 80 at the time of floor heating operation. Therefore, the water temperature of the floor heating pipe 80 may increase more quickly than an example where the first refrigerant passes through the indoor heat exchanger 18 or the hot water pump 60 and the hot water supply compressor 52 are operated.

Figure 6:
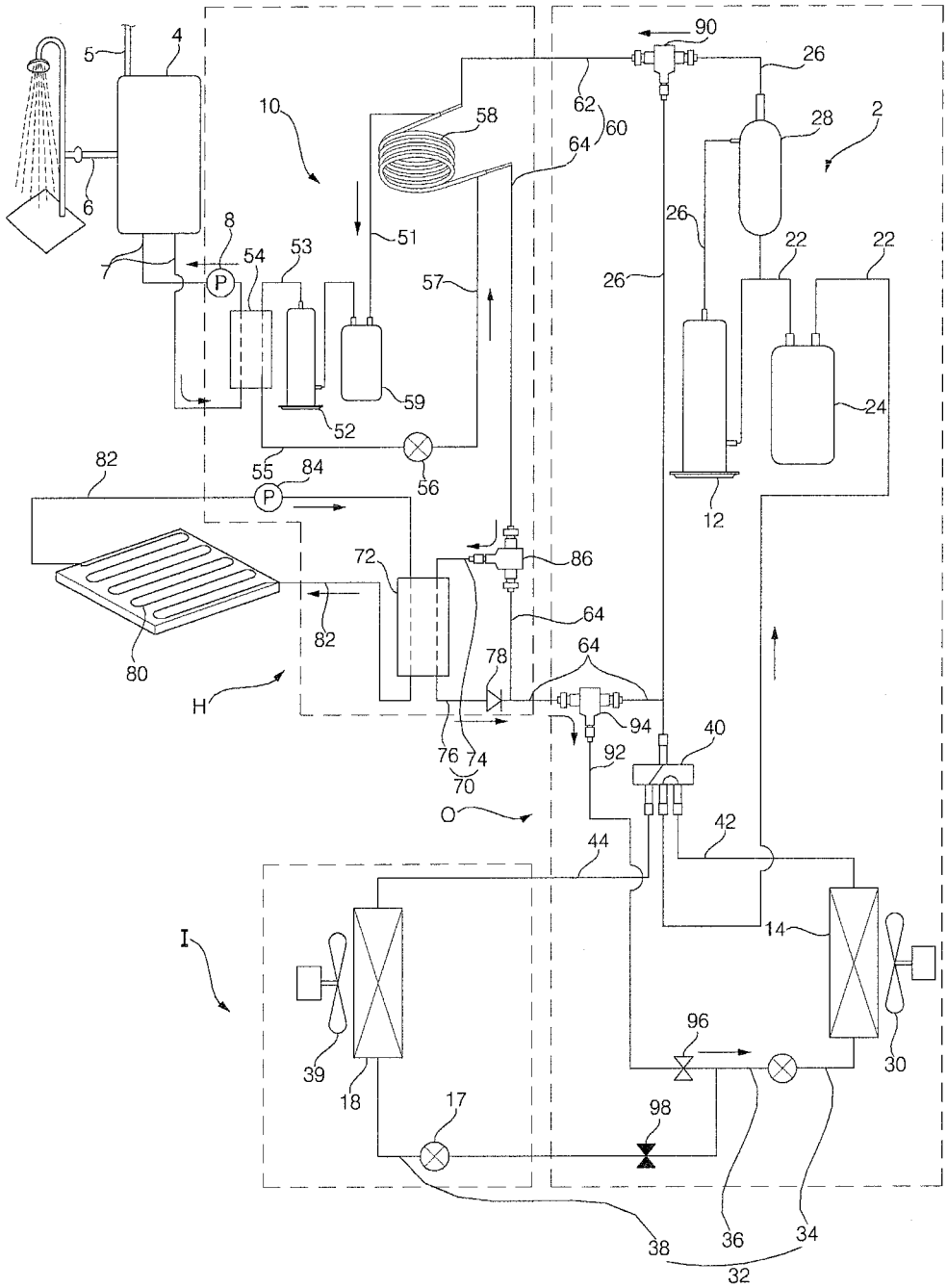
FIG. 6 is a block diagram illustrating a flow of a refrigerant when the first embodiment of the heat pump type speed heating apparatus (FIG. 2) is in both a floor heating operation and a hot water supply operation.

FIG. 6 is a block diagram illustrating a flow of a refrigerant when the first embodiment of the heat pump type speed heating apparatus (FIG. 2) is in both a floor heating operation and a hot water supply operation. Other embodiments and configurations may also be provided.

The heat pump type speed heating apparatus, in an example of simultaneous operation of a floor heating and a hot water supply, may operate as follows.

The compressor 12 may be operated. The refrigerant controller 90 may be controlled for the first refrigerant to flow into the cascade heat exchanger 58. The water refrigerant heat exchanger refrigerant controller 86 may be controlled for the refrigerant of the hot water supply outflow flow path 64 to pass through the water refrigerant heat exchanger 72. The auxiliary refrigerant controller 64 may be controlled for the refrigerant of the hot water supply outflow flow path 64 to pass through the heat exchanger bypass flow path 92. The outdoor fan 30 may rotate, and the indoor fan 39 may not rotate. The cooling/heating switching valve 40 may operate in a heating mode. The heat exchanger bypass valve 96 may be opened, and the liquid refrigerant valve 98 may be closed. The hot water pump 8 and the hot water supply compressor 52 may be operated, and the floor heating pump 84 may be operated.

At the time of operation of the compressor 12, the first refrigerant compressed at the compressor 12 may pass through the refrigerant controller 90 and the hot water supply inflow flow path 62, and may flow into the cascade heat exchanger 58. The first refrigerant heated at the compressor 12 may be condensed by exchanging heat with the second refrigerant while the first refrigerant passes through the cascade heat exchanger 58.

At the time of operating the hot water supply compressor 52, the second refrigerant compressed at the hot water supply compressor 52 may be condensed at the hot water supply heat exchanger 54, and may be expanded at the hot water supply expansion apparatus 56. The second refrigerant may then be evaporated by taking away the heat of the first refrigerant while passing through the cascade heat exchanger 58, and may be recovered by the hot water supply compressor 52.

At the time of operating the hot water pump 8, the water of the hot water supply tank 4 may flow into the hot water supply heat exchanger 54 through the hot water pipe 7. The water of the hot water supply tank 4 may then pass through the hot water supply heat exchanger 54, and may be circulated to the hot water supply tank 4. Water at much higher temperature (than when the hot water supply circuit 10 is not included) may flow into the inside of the hot water supply tank 4.

The first refrigerant condensed at the cascade heat exchanger 58 may flow into the water refrigerant heat exchanger refrigerant controller 86 and may flow into the water refrigerant heat exchanger 72 through the floor heating inflow flow path 74, and may be condensed again by exchanging heat with water while passing through the water refrigerant heat exchanger 72. The first refrigerant condensed at the water refrigerant heat exchanger 72 may flow into the hot water supply outflow flow path 64 through the floor heating inflow flow path 76 and may then pass through the auxiliary refrigerant controller 94, and flow into the heat exchanger bypass flow path 92. The first refrigerant that has flowed into the heat exchanger bypass flow path 92 may expand at the outdoor expansion apparatus 16 after passing through the heat exchanger bypass valve 96. Afterwards, the first refrigerant may be evaporated at the outdoor heat exchanger 14 by exchanging heat with the outdoor air. The first refrigerant evaporated at the outdoor heat exchanger 14 may be recovered by the compressor 12 after passing through the cooling/heating switching valve 40.

The first refrigerant discharged from the compressor 12 may be recovered by the compressor 12 after sequentially passing through the cascade heat exchanger 58, the water refrigerant heat exchanger 72, the heat exchanger bypass flow path 92, the outdoor expansion apparatus 16, the outdoor heat exchanger 14, and the cooling/heating switching valve 40.

The cascade heat exchanger 58 and the water refrigerant heat exchanger 72 may evaporate the second refrigerant while condensing the first refrigerant. The outdoor heat exchanger 14 may also evaporate the first refrigerant, and the hot water supply heat exchanger 54 may heat the water of the hot water supply tank 56 by condensing the second refrigerant.

The heat pump type speed heating apparatus may heat the water of the floor heating pipe 80 as the water refrigerant heat exchanger 72 again condenses the first refrigerant that was condensed for the first time at the cascade heat exchanger 58.

The heat pump type speed heating apparatus may use the first refrigerant to heat the water of the hot water supply tank 4 and the floor heating pipe 80 at the time of simultaneous operation of the floor heating and the hot water supply. The second refrigerant may be used for heating the water of the hot water supply tank 4. Therefore, the water temperature of the hot water supply tank 4 and the floor heating pipe 80 may be increased more quickly than an example where the first refrigerant passes through the indoor heat exchanger 18.

Figure 7:
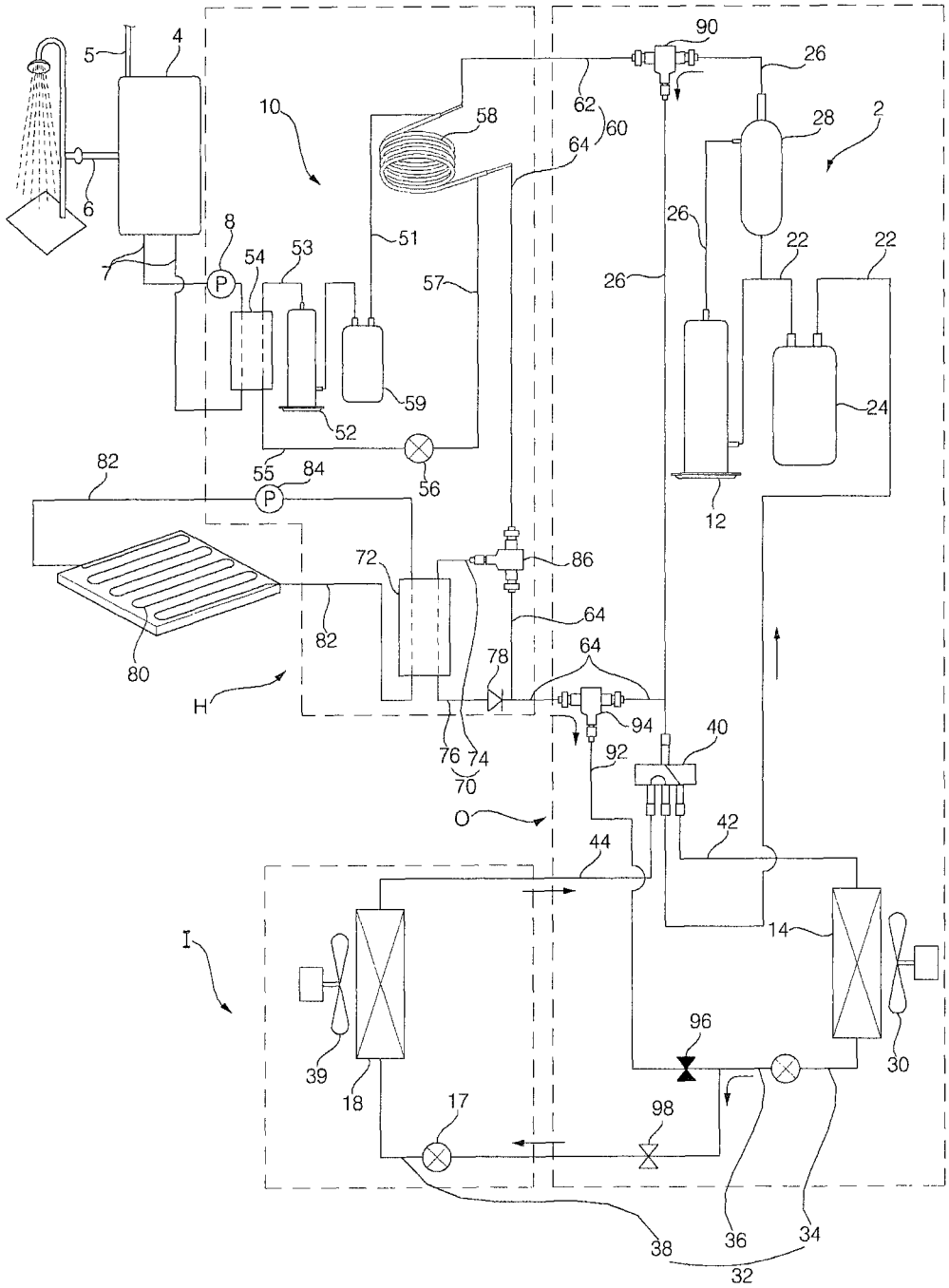
FIG. 7 is a block diagram illustrating a flow of a refrigerant when the first embodiment of the heat pump type speed heating apparatus (FIG. 2) is in a space cooling operation.

FIG. 7 is a block diagram illustrating a flow of a refrigerant when the first embodiment of the heat pump type speed heating apparatus (FIG. 2) is in a space cooling operation. Other embodiments and configurations may also be provided.

The heat pump type speed heating apparatus, in an example of a space cooling operation during air conditioning, may operate as follows.

The compressor 12 may be operated. The refrigerant controller 90 may be controlled for the refrigerant to flow into the cooling/heating switching valve 40 while bypassing the cascade heat exchanger 58, the water refrigerant heat exchanger 72, and the auxiliary refrigerant controller 94. The auxiliary refrigerant controller 94 may be controlled for the first refrigerant of the hot water supply outflow flow path 64 to flow into the heat exchanger bypass flow path 92. The outdoor fan 30 and the indoor fan 39 may rotate. The cooling/heating switching valve 40 may operate in a cooling mode. The heat exchanger bypass valve 96 may be closed, and the liquid refrigerant valve 98 may be opened. The hot water pump 60, the hot water supply compressor 52, and the floor heating pump 84 may not operate.

The first refrigerant compressed at the compressor 12 at the time of operating the compressor 12 may pass through the refrigerant controller 90 and flow into the cooling/heating switching valve 40 by bypassing the cascade heat exchanger 58 and the water refrigerant heat exchanger 72. Afterwards, the first refrigerant may be condensed at the outdoor heat exchanger 14 by exchanging heat with the outdoor air. The first refrigerant condensed at the outdoor heat exchanger 14 may be expanded by at least one of the outdoor expansion apparatus 16 and the indoor expansion apparatus 17, and may be evaporated at the indoor heat exchanger 18. The first refrigerant evaporated at the indoor heat exchanger 18 may be recovered by the compressor 12 after passing through the cooling/heating switching valve 40.

The first refrigerant discharged from the compressor 12 may be recovered by the compressor 12 after sequentially passing through the cooling/heating switching valve 40, the outdoor heat exchanger 14, the outdoor expansion apparatus 16, the indoor expansion apparatus 17, the indoor heat exchanger 18, and the cooling/heating switching valve 40.

The outdoor heat exchanger 14 may condense the first refrigerant, the indoor heat exchanger 18 may evaporate the first refrigerant, and the indoor air may be cooled down by exchanging heat with the indoor heat exchanger 18.

The heat pump type speed heating apparatus may use the first refrigerant to cool down indoor air at the time of a space cooling operation.

The heat pump type speed heating apparatus, in an example of a space cooling operation during air conditioning, may use only the mode of the cooling/heating switching valve 40 as a heating mode while others are the same as the space cooling operation during air conditioning. In the example of a space heating operation, the indoor heat exchanger 18 may condense the first refrigerant, the outdoor heat exchanger 14 may evaporate the first refrigerant, and the indoor air may be heated by exchanging heat with the indoor heat exchanger 18.

Figure 8:
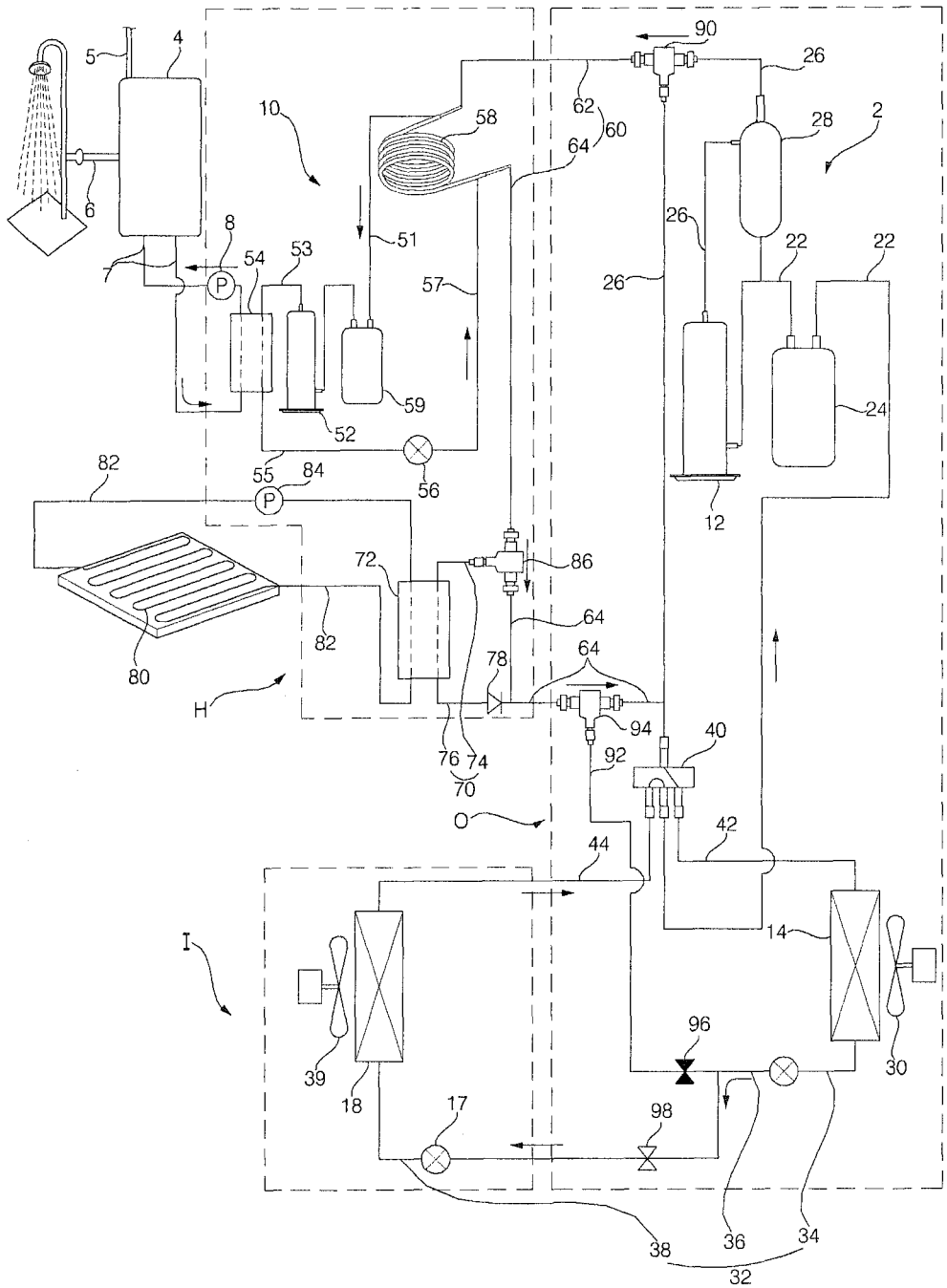
FIG. 8 is a block diagram illustrating a flow of a refrigerant when the first embodiment of the heat pump type speed heating apparatus (FIG. 2) is in both a space cooling operation and a hot water supply operation.

FIG. 8 is a block diagram illustrating a flow of a refrigerant when the first embodiment of the heat pump type speed heating apparatus (FIG. 2) is in both a space cooling operation and a hot water supply operation. Other embodiments and configurations may also be provided.

The heat pump type speed heating apparatus, in an example of simultaneous operation of a space cooling and a hot water supply, may operate as follows.

The compressor 12 may be operated. The refrigerant controller 90 may be controlled for the first refrigerant to flow into the cascade heat exchanger 58. The water refrigerant heat exchanger refrigerant controller 86 may be controlled for the refrigerant of the hot water supply outflow flow path 64 to bypass the water refrigerant heat exchanger 72. The auxiliary refrigerant controller 64 may be controlled for the refrigerant of the hot water supply outflow flow path 64 to bypass the heat exchanger bypass flow path 92 and to flow into the cooling/heating switching valve 40. The outdoor fan 30 may rotate, and the indoor fan 39 may rotate. The cooling/heating switching valve 40 may operate in a cooling mode. The heat exchanger bypass valve 96 may be closed, and the liquid refrigerant valve 98 may be opened. The hot water pump 8 and the hot water supply compressor 52 may be operated, and the floor heating pump 84 is not operated.

At the time of operation of the compressor 12, the first refrigerant compressed at the compressor 12 may pass through the refrigerant controller 90 and the hot water supply inflow flow path 62, and may flow into the cascade heat exchanger 58. The first refrigerant heated at the compressor 12 may be condensed by exchanging heat with the second refrigerant while the first refrigerant passes through the cascade heat exchanger 58.

At the time of operating the hot water supply compressor 52, the second refrigerant compressed at the hot water supply compressor 52 may be condensed at the hot water supply heat exchanger 54, and may be expanded at the hot water supply expansion apparatus 56. The second refrigerant may then be evaporated by taking away the heat of the first refrigerant while passing through the cascade heat exchanger 58, and may be recovered by the hot water supply compressor 52.

At the time of operating the hot water pump 8, the water of the hot water supply tank 4 may flow into the hot water supply heat exchanger 54 through the hot water pipe 7. The water of the hot water supply tank 4 may then pass through the hot water supply heat exchanger 54 and may be circulated to the hot water supply tank 4. Water at a much higher temperature (than when the hot water supply circuit 10 is not included) may flow into the inside of the hot water supply tank 4.

The first refrigerant condensed at the cascade heat exchanger 58 may flow into the water refrigerant heat exchanger refrigerant controller 86 and may bypass the water refrigerant heat exchanger 72, and may flow into the auxiliary refrigerant controller 94. The first refrigerant that has flowed into the auxiliary refrigerant controller 94 may flow into the cooling/heating switching valve 40 and may be condensed again at the outdoor heat exchanger 14.

The first refrigerant condensed at the outdoor heat exchanger 14 may expand while passing through one of the outdoor expansion apparatus 16 and the indoor expansion apparatus 17. The first refrigerant may evaporate while passing through the indoor heat exchanger 18. Afterwards, the first refrigerant may be recovered by the compressor 12 as the first refrigerant passes through the cooling/heating switching valve 40.

The first refrigerant discharged from the compressor 12 may be recovered by the compressor 12 after sequentially passing through the cascade heat exchanger 58, the cooling/heating switching valve 40, the outdoor heat exchanger 14, the outdoor expansion apparatus 16, the indoor expansion apparatus 17, the indoor heat exchanger 18, and the cooling/heating switching valve 40.

The cascade heat exchanger 58 may evaporate the second refrigerant while condensing the first refrigerant. The outdoor heat exchanger 14 may again condense the first refrigerant. The indoor heat exchanger 18 may evaporate the first refrigerant. The hot water supply heat exchanger 54 may condense the second refrigerant. The hot water supply heat exchanger 54 may heat the water of the hot water supply tank 4.

The heat pump type speed heating apparatus, at the time of simultaneous operation of the hot water supply and the space cooling, may use the first refrigerant and the second refrigerant to heat the water of the hot water supply tank 4. The first refrigerant may be used for cooling down indoor air after being used to heat the water of the hot water supply tank 4. Therefore, the water temperature of the hot water supply tank 4 may increase more quickly and at the same time, an indoor space may be cooled down.

Figure 9:
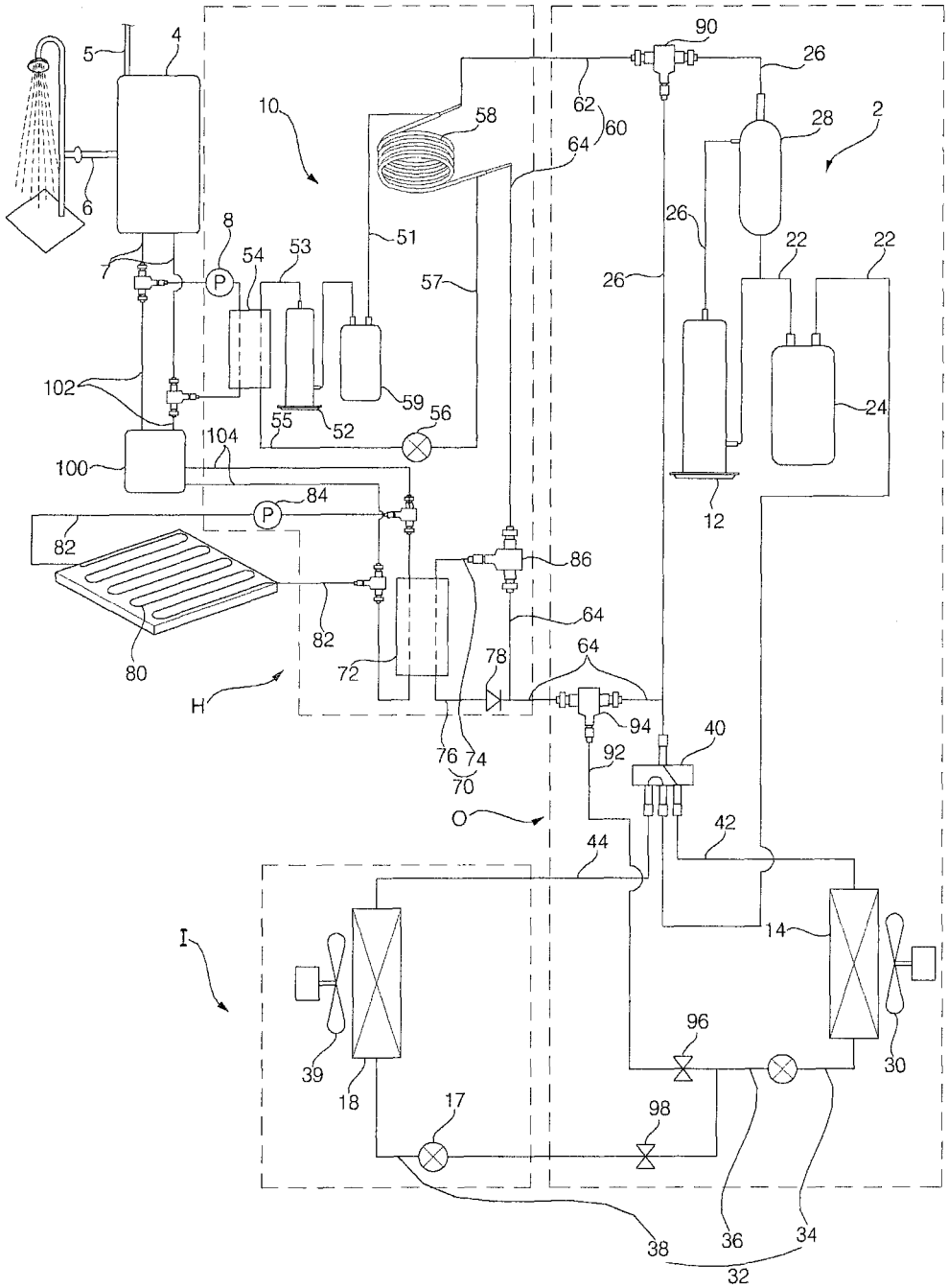
FIG. 9 is a second embodiment of a heat pump type speed heating apparatus according to the present invention.

FIG. 9 is a second embodiment of a heat pump type speed heating apparatus according to the present invention. Other embodiments and configurations may also be provided.

A heat pump type speed heating apparatus in an example of operating at least one of a hot water supply and a floor heating, may further include a heat storage tank 100 where heat of a refrigerant is stored. Since the remaining structure and functions except for the heat storage tank 100 are identical or similar to the above-described first embodiment, same symbols may be used and a detailed description corresponding thereto may be omitted.

The heat storage tank 100 may store heat during a night time when electricity cost is low and may provide the heat of the heat storage tank 100 for the hot water supply tank 4 and the floor heating pipe 80 during a daytime when the electricity cost is high.

The heat storage tank 100, connected to at least one of a hot water pipe 7 and a heating water pipe 82, may store heat at the time of operating at least one of the hot water supply and the floor heating. Besides the hot water supply operation or the floor heating operation, a heat storage operation may be separately performed, thereby storing heat.

The heat storage operation may store heat of the first refrigerant and the second refrigerant into the heat storage tank 100 or store the heat of the first refrigerant. The heat storage operation may be performed in the same way as the hot water supply operation or the floor heating operation.

At the time of heat storage operation, the compressor 12 and the hot water supply compressor 52 may operate together or the compressor 12 alone can be operated.

The heat storage tank 100 may be connected to the hot water pipe 7, although not to the heating water pipe 82, so that heat is stored when the first refrigerant passes through the cascade heat exchanger 58, and the stored heat can afterwards be transferred to the hot water supply tank 4.

The heat storage tank 100 may be connected to the heating water pipe 82, although not to the hot water pipe 7, so that heat is stored when the first refrigerant passes through the water refrigerant heat exchanger 72 and the stored heat can afterwards be transferred to the floor heating pipe 80.

If the heat storage tank 100 is connected to one of the hot water pipe 7 and the heating water pipe 82, the heat storage tank 100 may be connected to the hot water pipe 7 where the heat of the first refrigerant and the second refrigerant can be stored together.

The heat storage tank 100 may be connected to both the hot water pipe 7 and the heating water pipe 82, thereby storing heat at the time of at least one operation or at the time of a separate heat storage operation.

The heat storage tank 100 may be connected to the hot water pipe 7 through a first heat storage pipe 102 and may be connected to the heating water pipe 82 through a second heat storage pipe 104.

The heat storage tank 100 may be connected to the hot water supply tank 4 in parallel, and the water pumped at the hot water pump 8 may be provided to the heat storage tank 100 and the hot water supply tank 4. If the hot water pump 8 is operated at the time stored heat is used, the water of the heat storage tank 100 and the hot water supply tank 4 may be circulated, thereby increasing the temperature of the hot water supply tank 4.

The heat storage tank 100 may be connected to the water refrigerant heat exchanger 72 in parallel, and the water pumped at the floor heating pipe 80 may be provided to the heat storage tank 100 and the water refrigerant heat exchanger 72. If the floor heating pump 84 is operated at the time stored heat is used, the water of the heat storage tank 100 and the floor heating pipe 80 may be circulated, thereby increasing the temperature of the floor heating pipe 80.

In the following, operations according to the above-described embodiment may be described.

The heat storage tank 100 may store heat of the hot water heat exchanger 54 or the water refrigerant heat exchanger 72 during simultaneous operation of a hot water supply and a floor heating, a hot water supply operation, and/or a floor heating operation.

As described above, if the heat pump type speed heating apparatus has to operate both a hot water supply and an air conditioning while the heat of the first refrigerant and the second refrigerant is stored or the heat of the first refrigerant is stored in the heat storage tank 100 (i.e., both the hot water supply load and the air conditioning load exist), the heat pump type speed heating apparatus may operate air conditioning and as the hot water pump 8 operates, the water of the heat storage tank 100 may circulate into the hot water supply tank 4, thereby heating the hot water supply tank 4.

The refrigerant controller 90 may control the first refrigerant to flow into the cooling/heating switching valve 40 by bypassing the cascade heat exchanger 58, and the hot water supply compressor 52 is not operated although the hot water pump 8 is operated.

The first refrigerant may perform indoor air conditioning by circulating the compressor 12, the cooling/heating switching valve 40, the outdoor heat exchanger 14, the outdoor expansion apparatus 16, the indoor expansion apparatus 17, and the indoor heat exchanger 18, and the water of the heat storage tank 100 may heat the inside of the hot water supply tank 4 by circulating the hot water supply tank 4 and the heat storage tank 100.

If the heat pump type speed heating apparatus has to operate both the floor heating and the air conditioning while the heat of the first refrigerant and the second refrigerant is stored or the heat of the first refrigerant is stored in the heat storage tank 100 (i.e., both the floor heating load and the air conditioning load exist), the heat pump type speed heating apparatus may operate the air conditioning and as the floor heating pump 84 operates, the water of the heat storage tank 100 may circulate into the floor heating pipe 80, thereby heating the floor heating pipe 80.

The refrigerant controller 90 may control the first refrigerant to flow into the cooling/heating switching valve 40 by bypassing the cascade heat exchanger 58 and the floor heating pump 84 is operated.

The first refrigerant may perform indoor air conditioning by circulating the compressor 12, the cooling/heating switching valve 40, the outdoor heat exchanger 14, the outdoor expansion apparatus 16, the indoor expansion apparatus 17, and the indoor heat exchanger 18, and the water of the heat storage tank 100 may heat the floor heating pipe 80 by circulating the floor heating pipe 80 and the heat storage tank 100.

The heat storage tank 100 may be connected to the indoor heat exchanger 18.

If the heat storage tank 100 is connected to the indoor heat exchanger 18, a refrigerant flow path through which the first refrigerant passes and a water flow path through which water passes may be formed separately in the indoor heat exchanger 18, and the heat of the first refrigerant may be stored in the heat storage tank 100 through the water flow path and subsequently may be transferred again to the indoor heat exchanger 18 through the water flow path.

The heat storage tank 100 may store heat at the time of the air conditioning operation and subsequently, at the time of simultaneous operation of the air conditioning and the hot water supply, simultaneous operation of the hot water supply and the floor heating, and/or simultaneous operation of the hot water supply, the floor heating, and the air conditioning, and the stored heat of the heat storage tank 100 may be used by the indoor heat exchanger 38 as the heat pump type speed heating apparatus is operated by the hot water supply operation or the floor heating operation, improving efficiency of the hot water supply and the floor heating may be made possible.

Figure 10:
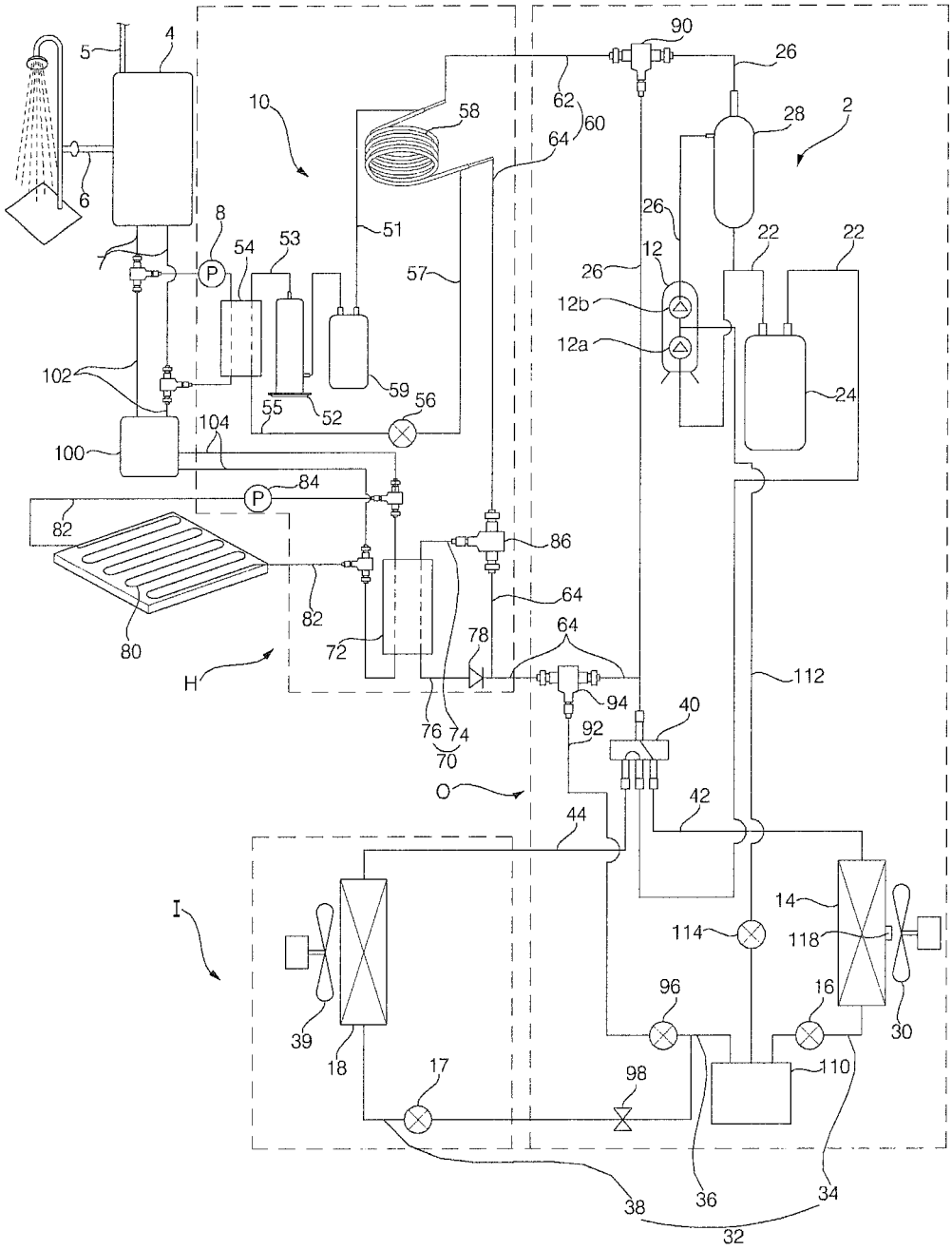
FIG. 10 is a third embodiment of a heat pump type speed heating apparatus according to the present invention.

FIG. 10 is a third embodiment of a heat pump type speed heating apparatus according to the present invention. Other embodiments and configurations may also be provided.

The heat pump type speed heating apparatus may include a multi-stage compressor where the compressor 12 compresses the first refrigerant in a multi-step.

The compressor 12 may include a low pressure side compression unit 12*a* and a high pressure compression unit 12*b* connected to the low pressure compression unit 12*a* to compress the refrigerant compressed at the low pressure compression unit 12*a*.

The low pressure compression unit 12*a* and the high pressure compression unit 12*b* of the compressor 12 may be connected to each other in series. An inflow flow path 22 of the compressor 12 can be connected to the low pressure compression unit 12*a* and a discharge flow path 26 of the compressor 12 can be connected to the high pressure compression unit 12*b*.

A gas-liquid separator 110 may be provided between the outdoor expansion apparatus 16 and the indoor expansion apparatus 17. An injection line 112 that injects a vaporized refrigerant by using the compressor 12 may be connected to the gas-liquid separator 110.

The gas-liquid separator 110 may be provided between the heat exchanger bypath flow path 92 and the outdoor expansion apparatus 16 to inject the vaporized refrigerant to the compressor 12 at the time of simultaneous operation of the hot water supply and the heating, the hot water supply operation, and/or the heating operation.

One end of the injection line 112 may be connected to the gas-liquid separator 110, and the other end of the injection line 112 may be connected between the low pressure compression unit 12*a* and the high pressure compression unit 12*b*.

An injection refrigerant controller 114 may be provided at the injection line 112 to control the vaporized refrigerant that is injected into the compressor 12.

The injection refrigerant controller 114 is intended to control the vaporized refrigerant that has flowed out from the gas-liquid separator 110. The injection refrigerant controller 114 can be composed of an opening and closing valve whose opening and closing is controlled by on-off control. The injection refrigerant controller 114 can also be composed of an electronic expansion valve whose opening angle is controlled.

The injection refrigerant controller 114 may be closed at the time of a starting operation of the heat pump type speed heating apparatus, and may be opened after stabilization of the heat pump type speed heating apparatus.

The injection refrigerant controller 114 may be always opened after stabilization of the heat pump type speed heating apparatus, and may be opened according to temperature of the outdoor heat exchanger 14 after stabilization of the heat pump type speed heating apparatus.

A temperature sensor 118 that senses temperature may be provided at the outdoor heat exchanger 14. The injection refrigerant controller 114 may be opened when the sensed temperature of the temperature sensor 118 is a predetermined temperature or less after stabilization of the heat pump type speed heating apparatus.

The heat pump type speed heating apparatus can include an electronic expansion valve that lowers pressure of the vaporized refrigerant injected to the injection line 112 to an intermediate pressure between a condensation pressure of the hot water supply heat exchanger 4 and an evaporation pressure of the outdoor heat exchanger 14 while preventing the liquid refrigerant inside the gas-liquid separator 110 from flowing into the injection line 112 at a time of simultaneous operation of the hot water supply and the heating, the hot water supply operation, and/or the heating operation.

The electronic expansion valve may be provided between the auxiliary refrigerant controller 10 and the gas-liquid separator 110. The electronic expansion valve may be provided between the heat exchanger bypass valve 96 (of the first embodiment) and the gas-liquid separator 110. The electronic expansion valve may also be provided between the auxiliary refrigerant controller 94 (of the first embodiment) and the heat exchanger bypass valve 96.

If the heat exchanger bypass valve 96 is composed of an electronic expansion valve, at the time of simultaneous operation of the hot water supply and the floor heating, the hot water supply operation, and/or the floor heating operation, pressure of the refrigerant that passes through the heat exchanger bypass flow path 92 is lowered to an intermediate pressure between a condensation pressure and an evaporation pressure; when the heat pump type speed heating apparatus performs defrosting operation during the hot water supply operation, simultaneous operation of the air conditioning and the hot water supply, simultaneous operation of the air conditioning, the hot water supply, and the flow heating, and/or the air conditioning operation, the heat exchanger bypass valve 96 can be closed.

Since the remaining structure and functions except for the compressor 12, the heat exchanger bypass valve 96, the gas-liquid separator 110, the injection line 112, and the injection refrigerant controller 114 are identical or similar to the first embodiment, the same symbols may be used and a detailed description corresponding thereto may be omitted.

In the following, a description may be provided with an example of hot water supply operation.

The heat pump type speed heating apparatus, at the time of a hot water supply operation, may operate as described in the first embodiment. If the outdoor heat exchanger 14 is at a predetermined temperature or less while the heat pump type speed heating apparatus is stabilized after starting, the heat exchanger bypass valve 96 may expand the refrigerant to a pressure between a condensation pressure of the cascade heat exchanger 58 and an evaporation pressure of the outdoor heat exchanger 14 and the injection refrigerant controller 114 is opened.

At the time of refrigerant expansion of the heat exchanger bypass valve 96 and opening of the injection refrigerant controller 114, a refrigerant with an intermediate pressure injected through the injection line 112 may flow between the low pressure compression unit 12*a* and the high pressure compression unit 12*b* of the compressor 12. Therefore, a compression period may be reduced according to injection of the refrigerant with intermediate pressure; effective hot water supply may be made possible at a cold area or at low outdoor temperature due to increase of condensation capacity of the cascade heat exchanger 58; and a highest management temperature of the compressor 12 may be lowered.

Even at the time of simultaneous operation of the floor heating and the hot water supply or the floor heating operation, a refrigerant of an intermediate pressure as described above may be injected to the compressor 12 and an efficient operation may be made possible for the heat pump type speed heating apparatus.

Figure 11:
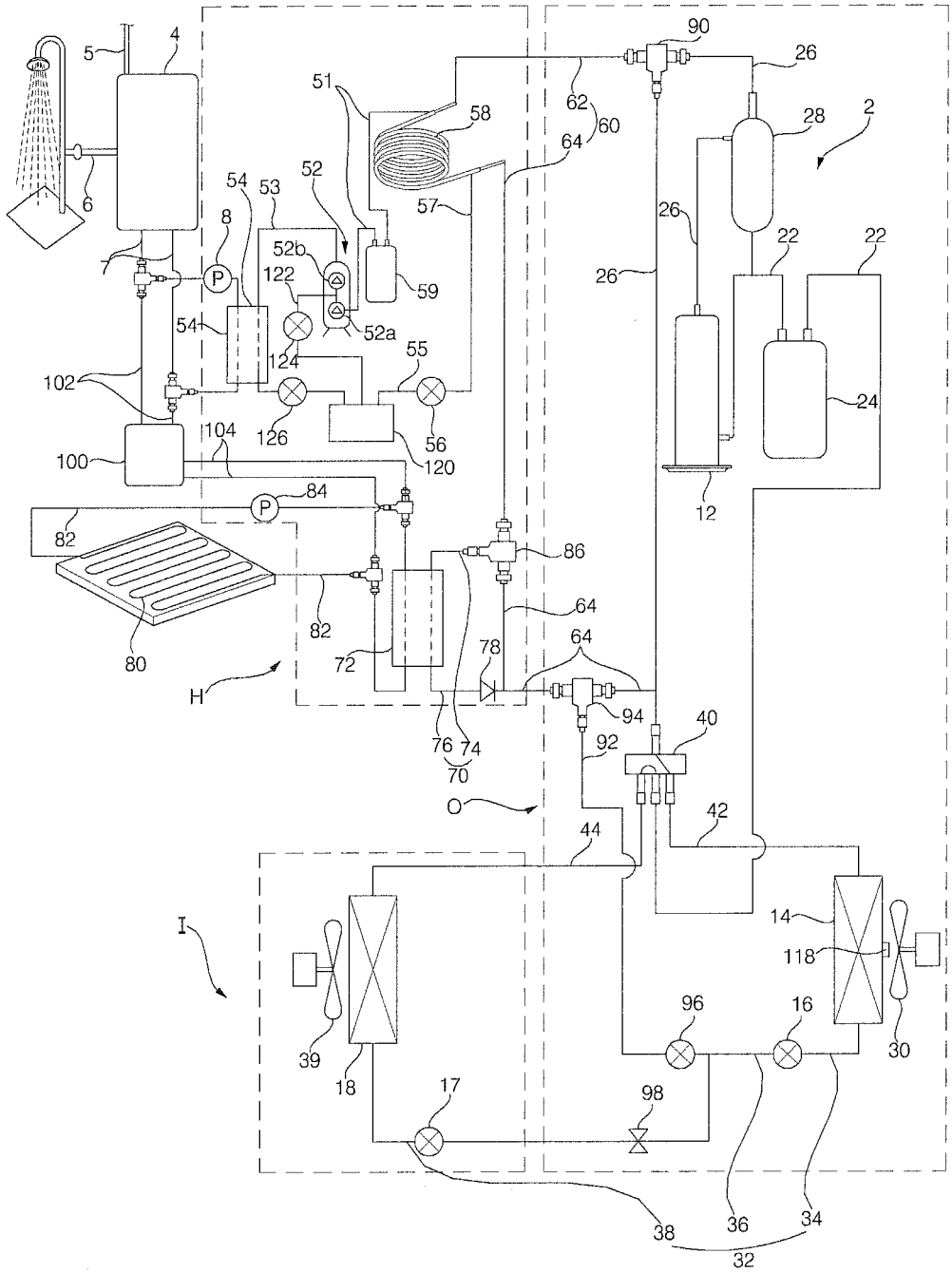
FIG. 11 is a fourth embodiment of a heat pump type speed heating apparatus according to the present invention.

FIG. 11 is a fourth embodiment of a heat pump type speed heating apparatus according to the present invention. Other embodiments and configurations may also be provided.

The heat pump type speed heating apparatus may include a multi-stage compressor where the hot water supply compressor 52 compresses the second refrigerant in a multi-step.

The compressor 52 can include a low pressure side compression unit 52*a* and a high pressure compression unit 52*b* connected to the low pressure compression unit 52*a* to compress the refrigerant compressed at the low pressure compression unit 52*a*.

The low pressure compression unit 52*a* and the high pressure compression unit 52*b* of the hot water supply compressor 52 may be connected to each other in series. An inflow flow path 51 of the compressor 52 can be connected to the low pressure compression unit 52*a* and a discharge flow path 53 of the compressor 52 can be connected to the high pressure compression unit 52*b*.

A gas-liquid separator 120 may be provided between the hot water supply heat exchanger 54 and the hot water supply expansion apparatus 56. An injection line 122, which injects a vaporized refrigerant by using the hot water supply compressor 52, may be connected to the gas-liquid separator 120.

The gas-liquid separator 120 and the injection line 122 are intended to inject the vaporized refrigerant to the hot water supply compressor 52 at the time of the hot water supply operation, simultaneous operation of the hot water supply and the floor heating, and simultaneous operation of the hot water supply, the floor heating, and the air conditioning; one end of the injection line 122 may be connected to the gas-liquid separator 120 and the other end of the injection line 122 can be provided between the low pressure compression unit 52*a* and the high pressure compression unit 52*b*.

An injection refrigerant controller 124 may be installed at the injection line 122 to control the vaporized refrigerant that is injected into the hot water supply compressor 52.

The injection refrigerant controller 124 is intended to control the vaporized refrigerant that has flowed out from the gas-liquid separator 120. The injection refrigerant controller 124 may be composed of an opening and closing valve whose opening and closing is controlled by on-off control. The injection refrigerant controller 124 may also be composed of an electronic expansion valve whose opening angle is controlled.

The injection refrigerant controller 124 may be closed at the time of a starting operation of the hot water supply circuit 10, and may be opened after stabilization of the hot water supply circuit 10.

The heat pump type speed heating apparatus can include an electronic expansion valve 126 which lowers the pressure of the vaporized refrigerant injected to the injection line 122 to an intermediate pressure between a condensation pressure of the hot water supply heat exchanger 4 and an evaporation pressure of the cascade heat exchanger 58 while preventing the liquid refrigerant inside the gas-liquid separator 120 from flowing into the injection line 122 at the time of the hot water supply operation, simultaneous operation of the hot water supply and the floor heating, or simultaneous operation of the hot water supply, the floor heating, and the air conditioning.

The electronic expansion valve 126 can be provided between the hot water heat exchanger 54 and the gas-liquid separator 120.

Since the remaining structure and functions except for the hot water compressor 52, the electronic expansion valve 126, the gas-liquid separator 120, the injection line 122, and the injection refrigerant controller 124 are identical or similar to the first embodiment of the present invention, same symbols may be used and detailed description corresponding thereto may be omitted.

The heat pump type speed heating apparatus, at the time of the hot water supply operation, simultaneous operation of the hot water supply and the floor heating, or simultaneous operation of the hot water supply, the floor heating, and the air conditioning, is operated as described in the first embodiment of the present invention; while the heat pump type speed heating apparatus is stabilized after starting, the electronic expansion valve 126 expands the refrigerant to an intermediate pressure between condensation pressure of the hot water supply heat exchanger 54 and evaporation pressure of the cascade heat exchanger 58 and the injection refrigerant controller 124 is opened.

At the time of refrigerant expansion of the electronic expansion valve 126 and opening of the injection refrigerant controller 124, a refrigerant with intermediate pressure injected through the injection line 122 flows between the low pressure compression unit 52*a* and the high pressure compression unit 52*b* of the hot water supply compressor 52. Therefore, a compression period of the hot water supply compressor 52 can be reduced according to the injection of the refrigerant with intermediate pressure; effective hot water supply can be made possible at a cold area or at low outdoor temperature due to increase of condensation capacity of the hot water supply heat exchanger 54; and a highest management temperature of the hot water supply compressor 52 can be lowered.

Embodiments of the present invention are not limited to the above-described embodiments although the heat pump type speed heating apparatus can also be operated by at least one of air conditioning operation and hot water supply operation without floor heating operation and not including the water refrigerant heat exchanger connecting flow path 70, the water refrigerant heat exchanger 72, the check valve 78, the floor heating pipe 80, the heating water pipe 82, the floor heating pump 84, and the water refrigerant heat exchanger refrigerant controller 86; various embodiments may be possible within the technical scope to which the present invention belongs.

The heat pump type speed heating apparatus may improve hot water supply performance since both the cooling cycle circuit and the hot water supply circuit can increase the temperature of the hot water supply tank; refrigerant condensed while heating the cascade heat exchanger at the time of simultaneous operation of the hot water supply and the air conditioning can enhance air conditioning performance as the refrigerant passes through the indoor heat exchanger and the outdoor heat exchanger.

A high efficiency may be achieved since the hot water supply, the floor heating, and the space air conditioning can be performed together.

Additionally, hot water supply performance is improved since the refrigerant that has passed the cascade heat exchanger at the time of hot water supply operation bypasses either of the indoor heat exchanger and the outdoor heat exchanger.

The hot water supply can be provided continuously by defrosting the outdoor heat exchanger during hot water supply operation.

At the time of hot water supply operation, as the refrigerant at an intermediate pressure between the condensation pressure and the evaporation pressure is injected into the compressor, degradation of hot water supply performance under outdoor low temperature environments is prevented; efficiency of hot water supply is high since condensation performance of the cascade heat exchanger can be improved.

Efficiency of the hot water supply may be high since condensation performance of the hot water supply heat exchanger can be improved by injecting the refrigerant at an intermediate pressure between the condensation pressure and the evaporation pressure to the hot water supply compressor at the time of hot water supply operation.

Embodiments of the present invention may provide a heat pump type speed heating apparatus with high efficiency, where hot water supply temperature can be increased by making use of a low temperature cooling cycle and a high temperature cooling cycle; and a refrigerant of the low temperature cooling cycle can be used for air conditioning after being used for hot water supply.

A heat pump type speed heating apparatus may include: a cooling cycle circuit capable of operating air conditioning (including a compressor through which a first refrigerant passes, an outdoor heat exchanger, an expansion apparatus, and an indoor heat exchanger); a hot water supply compressor which include a hot water supply circuit where a second refrigerant heats water of a hot water supply tank, the second refrigerant being compressed in the hot water supply circuit; a hot water supply heat exchanger where the second refrigerant compressed in the hot water supply compressor is condensed while heating water; a hot water supply expansion apparatus where the second refrigerant condensed in the hot water supply heat exchanger is expanded; and a cascade heat exchanger connected to the cooling cycle circuit for the first refrigerant discharged from the compressor to evaporate the second refrigerant expanded at the hot water supply expansion apparatus and undergo a process of condensation, expansion, and evaporation in the cooling cycle circuit.

The heat pump type speed heating apparatus can further include a water refrigerant heat exchanger connected to a water refrigerant heat exchanger connecting flow path for the first refrigerant that has passed through the cascade heat exchanger to be condensed, expanded, and evaporated in the cooling cycle circuit after heating water.

The heat pump type speed heating apparatus can further include a floor heating pipe connected to the water refrigerant heat exchanger through a heating water pipe and a floor heating pump installed at the heating water pipe.

The hot water supply tank can be connected to the hot water supply heat exchanger through a hot water pipe. A hot water pump can be installed in the hot water pipe. The heat pump type speed heating apparatus can further include a heat storage tank connected to at least one of the hot water pipe and the heating water pipe through a heat storage pipe.

The heat pump type speed heating apparatus can further include a water refrigerant heat exchanger refrigerant controller to control the flow of the refrigerant such that the first refrigerant that has passed the cascade heat exchanger can either pass through or bypass the water refrigerant heat exchanger.

The heat pump type speed heating apparatus can further include a refrigerant controller that controls the flow direction of the first refrigerant discharged from the compressor such that the first refrigerant discharged from the compressor either passes through or bypasses the cascade heat exchanger.

The heat pump type speed heating apparatus can further include a heat exchanger bypass flow path connected to guide the first refrigerant that has passed the cascade heat exchanger to a space between the outdoor heat exchanger and the indoor heat exchanger so that the first refrigerant that has passed the cascade heat exchanger can bypass either one of the outdoor heat exchanger and the indoor heat exchanger.

The expansion apparatus may include an indoor expansion apparatus and an outdoor expansion apparatus. The heat exchanger bypass flow path may be connected between the indoor expansion apparatus and the outdoor expansion apparatus.

The heat pump type speed heating apparatus can further include an auxiliary refrigerant controller that controls the flow direction of the first refrigerant that has passed the cascade heat exchanger so that the first refrigerant that has passed the cascade heat exchanger can either pass through or bypass the heat exchanger bypass flow path.

The auxiliary refrigerant controller can be controlled for the first refrigerant to flow through the heat exchanger bypass flow path at the time of hot water supply operation.

If defrosting conditions are provided during the hot water supply operation, the auxiliary refrigerant controller can be controlled such that the first refrigerant bypasses the heat exchanger bypass flow path; and the cooling cycle circuit can be switched from heating operation to cooling operation.

The auxiliary refrigerant controller can be controlled such that the refrigerant that has passed the cascade heat exchanger bypasses the heat exchanger bypass flow path when hot water supply and air conditioning are operated at the same time.

The heat pump type speed heating apparatus can further include a heat exchanger bypass valve being installed in the heat exchanger bypass flow path and controlling the flow of the first refrigerant.

The heat pump type speed heating apparatus can further include a liquid refrigerant valve installed between the heat exchanger bypass flow path and the indoor expansion apparatus, and that controls the flow of the first refrigerant.

The heat exchanger bypass valve can be opened at the time of hot water supply operation and the liquid refrigerant valve can be closed at the time of hot water supply operation.

The expansion apparatus can include an indoor expansion apparatus and an outdoor expansion apparatus. The heat pump type speed heating apparatus can further include a gas-liquid separator installed between the indoor expansion apparatus and the outdoor expansion apparatus, and an injection line injecting vaporized refrigerant of the gas-liquid separator into the compressor.

The heat pump type speed heating apparatus can further include an injection refrigerant controller that can be installed in the injection line to control vaporized refrigerant injected to the compressor, and can be closed at the time of starting operation and opened after stabilization.

The heat pump type speed heating apparatus can further include a gas-liquid separator installed between the hot water supply heat exchanger and the hot water supply expansion apparatus, and an injection line that injects vaporized refrigerant of the gas-liquid separator into the hot water supply compressor.

The heat pump type speed heating apparatus can further include an injection refrigerant controller that can be installed in the injection line to control vaporized refrigerant injected to the hot water supply compressor; closed at the time of starting operation and opened after stabilization.

The cooling cycle circuit can further include a cooling/heating switching valve that switches between cooling operation and heating operation. The cascade heat exchanger can be connected to the cooling cycle circuit and the hot water supply flow path. The hot water supply flow path can include a hot water supply inflow flow path leading the first refrigerant that has been compressed in the compressor to the cascade heat exchanger and a hot water outflow flow path leading the first refrigerant that has flowed out from the cascade heat exchanger to the cooling/heating switching valve. The hot water supply inflow flow path and the hot water supply outflow flow path can be connected to the compressor and the cooling/heating switching valve respectively.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat pump type speed heating apparatus, comprising:

a cooling cycle circuit to circulate a first refrigerant to operate an air conditioning, the cooling cycle circuit including a compressor, an outdoor heat exchanger, an expansion apparatus, and an indoor heat exchanger;

a hot water supply compressor to compress a second refrigerant;

a hot water supply heat exchanger to condense the compressed second refrigerant and to heat water based on the condensed second refrigerant;

a hot water supply tank to receive the heated water from the hot water supply heat exchanger;

a hot water supply expansion apparatus to expand the second refrigerant from the hot water supply heat exchanger;

a cascade heat exchanger to evaporate the second refrigerant expanded from the hot water supply expansion apparatus based on the first refrigerant from the compressor, and the first refrigerant to undergo condensation, expansion, and evaporation in the cooling cycle circuit;

a water refrigerant heat exchanger connected to a water refrigerant heat exchanger connecting flow path for the first refrigerant that has passed through the cascade heat exchanger to be condensed, expanded, and evaporated in the cooling cycle circuit after heating water; and a water refrigerant heat exchanger refrigerant controller to selectively control flow of the first refrigerant such that the first refrigerant that has passed the cascade heat exchanger either passes through the water refrigerant heat exchanger or bypasses the water refrigerant heat exchanger.

2. The apparatus of claim, further comprising:

a floor heating pipe connected to the water refrigerant heat exchanger by a heating water pipe, and a floor heating pump provided at the heating water pipe.

3. The apparatus of claim 1, wherein the hot water supply tank is connected to the hot water supply heat exchanger by a hot water pipe, and the heat pump type speed heating apparatus further comprises a hot water pump provided at the hot water pipe, and a heat storage tank.

4. The apparatus of claim 1, further comprising a refrigerant controller to control a flow of the first refrigerant from the compressor such that the first refrigerant either passes through the cascade heat exchange or bypasses the cascade heat exchanger.

5. The apparatus of claim 1, further comprising a heat exchanger bypass flow path to guide the first refrigerant that has passed the cascade heat exchanger such that the first refrigerant can bypass either the outdoor heat exchanger or the indoor heat exchanger.

6. The apparatus of claim 5, wherein the expansion apparatus includes an indoor expansion apparatus and an outdoor expansion apparatus, and the heat exchanger bypass flow path is between the indoor expansion apparatus and the outdoor expansion apparatus.

7. The apparatus of claim 5, further comprising an auxiliary refrigerant controller that selectively controls a flow of the first refrigerant that has passed the cascade heat exchanger such that the first refrigerant can either pass through the heat exchanger bypass flow path or bypass the heat exchanger bypass flow path.

8. The apparatus of claim 1, wherein the expansion apparatus comprises an indoor expansion apparatus and an outdoor expansion apparatus, and the heat pump type speed heating apparatus further comprises:

a gas-liquid separator between the indoor expansion apparatus and the outdoor expansion apparatus, and an injection line to inject vaporized refrigerant of the gas-liquid separator into the compressor.

9. The apparatus of claim 1, further comprising:

a gas-liquid separator between the hot water supply heat exchanger and the hot water supply expansion apparatus; and an injection line to inject vaporized refrigerant of the gas-liquid separator into the hot water supply compressor.

10. A heat pump type speed heating apparatus, comprising:

a cooling cycle circuit to circulate a first refrigerant to operate an air conditioning, the cooling cycle circuit including a compressor, an outdoor heat exchanger, an expansion apparatus, and an indoor heat exchanger;

a hot water supply compressor to compress a second refrigerant;

a hot water supply heat exchanger to condense the compressed second refrigerant and to heat water based on the condensed second refrigerant;

a hot water supply tank to receive the heated water from the hot water supply heat exchanger;

a hot water supply expansion apparatus to expand the second refrigerant from the hot water supply heat exchanger; and a cascade heat exchanger to evaporate the second refrigerant expanded from the hot water supply expansion apparatus based on the first refrigerant from the compressor, and the first refrigerant to undergo condensation, expansion, and evaporation in the cooling cycle circuit, wherein the cooling cycle circuit further includes a cooling/heating switching valve to switch between a cooling operation and a heating operation, wherein the cooling heating switching valve is connected to the compressor through a compressor inflow flow path and a compressor discharge flow path, the cascade heat exchanger is connected to the cooling cycle circuit through a hot water supply flow path, the hot water supply flow path includes a hot water supply inflow flow path to guide the first refrigerant compressed in the compressor to the cascade heat exchanger and a hot water outflow flow path to guide the first refrigerant flowed out from the cascade heat exchanger to the cooling/heating switching valve, and the hot water supply inflow flow path and the hot water supply outflow flow path are connected to the cooling cycle circuit via the compressor discharge flow path and the cooling/heating switching valve respectively.

11. A heat pump type speed heating apparatus, comprising:

a cooling cycle circuit to circulate a first refrigerant and perform a heating operation and a cooling operation, the cooling cycle circuit including a compressor, an outdoor heat exchanger, an expansion apparatus, and an indoor heat exchanger;

a hot water supply compressor to compress a second refrigerant;

a hot water supply heat exchanger to condense the compressed second refrigerant and to heat water of a hot water supply tank;

a hot water supply expansion apparatus to expand the second refrigerant from the hot water supply heat exchanger;

a cascade heat exchanger to perform a heat exchange between the first refrigerant from the compressor and the expanded second refrigerant from the hot water supply expansion apparatus, and the first refrigerant to condense, expand, and evaporate in the cooling cycle circuit after passing through the cascade heat exchanger;

a water refrigerant heat exchanger to receive the first refrigerant in the cooling cycle circuit after heating water; and a water refrigerant heat exchanger refrigerant controller to selectively control flow of the first refrigerant such that the first refrigerant that has passed the cascade heat exchange either passes through the water refrigerant heat exchanger or bypasses the water refrigerant heat exchanger.

12. The apparatus of claim 11, further comprising:

a floor heating pipe connected to the water refrigerant heat exchanger by a heating water pipe, and a floor heating pump provided at the heating water pipe.

13. The apparatus of claim 11, further comprising a refrigerant controller to control a flow of the first refrigerant from the compressor such that the first refrigerant either passes through the cascade heat exchange or bypasses the cascade heat exchanger.

14. The apparatus of claim 11, further comprising a heat exchanger bypass flow path to guide the first refrigerant that has passed the cascade heat exchanger such that the first refrigerant bypasses either one of the outdoor heat exchanger and the indoor heat exchanger.

15. The apparatus of claim 14, wherein the expansion apparatus includes an indoor expansion apparatus and an outdoor expansion apparatus; and the heat exchanger bypass flow path is between the indoor expansion apparatus and the outdoor expansion apparatus.

16. The apparatus of claim 14, further comprising an auxiliary refrigerant controller that controls a flow of the first refrigerant that has passed the cascade heat exchanger such that the first refrigerant either passes through the heat exchanger bypass flow path or bypasses the heat exchanger bypass flow path.

17. The apparatus of claim 11, wherein the expansion apparatus comprises an indoor expansion apparatus and an outdoor expansion apparatus, and the heat pump type speed heating apparatus further comprises:

a gas-liquid separator between the indoor expansion apparatus and the outdoor expansion apparatus, and an injection line to inject vaporized refrigerant of the gas-liquid separator into the compressor.

18. The apparatus of claim 11, further comprising:

a gas-liquid separator between the hot water supply heat exchanger and the hot water supply expansion apparatus; and an injection line to inject vaporized refrigerant of the gas-liquid separator into the hot water supply compressor.

19. A heat pump type speed heating apparatus, comprising:

a cooling cycle circuit to circulate a first refrigerant and perform a heating operation and a cooling operation, the cooling cycle circuit including a compressor, an outdoor heat exchanger, an expansion apparatus, and an indoor heat exchanger;

a hot water supply compressor to compress a second refrigerant;

a hot water supply heat exchanger to condense the compressed second refrigerant and to heat water of a hot water supply tank;

a hot water supply expansion apparatus to expand the second refrigerant from the hot water supply heat exchanger; and a cascade heat exchanger to perform a heat exchange between the first refrigerant from the compressor and the expanded second refrigerant from the hot water supply expansion apparatus, and the first refrigerant to condense, expand, and evaporate in the cooling cycle circuit after passing through the cascade heat exchanger, wherein the cooling cycle circuit further includes a cooling/heating switching valve to switch between a cooling operation and a heating operation, wherein the cooling/heating switching valve is connected to the compressor through a compressor inflow flow path and a compressor discharge flow path, the cascade heat exchanger is connected to the cooling cycle circuit through a hot water supply flow path, the hot water supply flow path includes a hot water supply inflow flow path to guide the first refrigerant compressed in the compressor to the cascade heat exchanger and a hot water outflow flow path to guide the first refrigerant flowed out from the cascade heat exchanger to the cooling/heating switching valve, and the hot water supply inflow flow path and the hot water supply outflow flow path are connected to the cooling cycle circuit via the compressor discharge flow path and the cooling/heating switching valve respectively.

* * * * *